US010487701B2

(12) United States Patent
McCloy et al.

(10) Patent No.: US 10,487,701 B2
(45) Date of Patent: Nov. 26, 2019

(54) SWITCHED CUSHION STOP

(71) Applicant: BorgWarner Inc., Auburn Hills, MI (US)

(72) Inventors: Chad McCloy, Cortland, NY (US); Brian Kenyon, McGraw, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 15/937,905

(22) Filed: Mar. 28, 2018

(65) Prior Publication Data

US 2018/0283232 A1 Oct. 4, 2018

Related U.S. Application Data

(60) Provisional application No. 62/477,763, filed on Mar. 28, 2017.

(51) Int. Cl.
*F01L 1/344* (2006.01)

(52) U.S. Cl.
CPC ..... *F01L 1/3442* (2013.01); *F01L 2001/3443* (2013.01); *F01L 2001/34426* (2013.01); *F01L 2001/34456* (2013.01); *F01L 2001/34469* (2013.01); *F01L 2001/34483* (2013.01); *F01L 2001/34496* (2013.01); *F01L 2250/02* (2013.01); *F01L 2250/04* (2013.01); *F01L 2250/06* (2013.01)

(58) Field of Classification Search
CPC ..... F01L 1/3442; F01L 2001/34423; F01L 2001/3443; F01L 2001/34456; F01L 1/46
USPC ..... 123/90.15
See application file for complete search history.

(56) References Cited

U.S. PATENT DOCUMENTS

| | | | | |
|---|---|---|---|---|
| 4,601,231 | A | 7/1986 | Shimoda | |
| 6,390,043 | B1 | 5/2002 | Niethammer et al. | |
| 6,772,721 | B1 * | 8/2004 | Gardner | F01L 1/022 123/90.17 |
| 7,194,992 | B2 * | 3/2007 | Smith | F01L 1/34 123/90.15 |
| 7,240,651 | B1 * | 7/2007 | Hanshaw | F01L 1/022 123/90.15 |
| 7,610,883 | B2 | 11/2009 | Noguchi | |
| 2001/0054406 | A1 * | 12/2001 | Okada | F01L 1/3442 123/90.17 |
| 2011/0000449 | A1 | 1/2011 | Urushihata et al. | |
| 2015/0033907 | A1 * | 2/2015 | Iyanaga | F16H 25/08 74/568 T |
| 2015/0377085 | A1 | 12/2015 | Radinger et al. | |

* cited by examiner

*Primary Examiner* — Jorge L Leon, Jr.
(74) *Attorney, Agent, or Firm* — Brown & Michaels, PC

(57) ABSTRACT

A switched cushion stop for a variable cam timing phaser of a variable cam timing system is disclosed. The cushion stop may be actively controlled by the spool valve or passively controlled.

14 Claims, 27 Drawing Sheets

SWITCHED CUSHION STOP

REFERENCE TO RELATED APPLICATIONS

This application claims one or more inventions which were disclosed in Provisional Application No. 62/477,763, filed Mar. 28, 2017, entitled "SWITCHED CUSHION STOP". The benefit under 35 USC § 119(e) of the United States provisional application is hereby claimed, and the aforementioned application is hereby incorporated herein by reference.

BACKGROUND OF THE INVENTION

Field of the Invention

The invention pertains to the field of variable cam timing systems. More particularly, the invention pertains to a switched cushion stop for a variable cam timing phaser of a variable cam timing system.

Description of Related Art

Internal combustion engines have employed various mechanisms to vary the relative timing between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). Vane phasers have a rotor with one or more vanes, mounted to the end of the camshaft, surrounded by a housing assembly with the vane chambers into which the vanes fit. It is possible to have the vanes mounted to the housing assembly, and the chambers in the rotor assembly, as well. The housing's outer circumference forms the sprocket, pulley or gear accepting drive force through a chain, belt, or gears, usually from the crankshaft, or possibly from another camshaft in a multiple-cam engine.

Apart from the camshaft torque actuated (CTA) variable camshaft timing (VCT) systems, the majority of hydraulic VCT systems operate under two principles, oil pressure actuation (OPA) or torsional assist (TA). In the oil pressure actuated VCT systems, an oil control valve (OCV) directs engine oil pressure to one working chamber in the VCT phaser while simultaneously venting the opposing working chamber defined by the housing assembly, the rotor assembly, and the vane. This creates a pressure differential across one or more of the vanes to hydraulically push the VCT phaser in one direction or the other. Neutralizing or moving the valve to a null position puts equal pressure on opposite sides of the vane and holds the phaser in any intermediate position. If the phaser is moving in a direction such that valves will open or close sooner, the phaser is said to be advancing and if the phaser is moving in a direction such that valves will open or close later, the phaser is said to be retarding.

The torsional assist (TA) systems operates under a similar principle with the exception that it has one or more check valves to prevent the VCT phaser from moving in a direction opposite than being commanded, should it incur an opposing force such as a torque impulse caused by cam operation.

The motion of the rotor assembly relative to the housing assembly can be halted by a lock pin, which in a locked position locks the rotor assembly to the housing assembly by being received in both the rotor assembly and the housing assembly. In an unlocked position, the lock pin only is received by the rotor assembly. It should be noted that the lock pin can also be received by the housing assembly and engage the rotor assembly to lock the relative motion of the rotor assembly to the housing assembly.

When the phaser is moving towards a position in which a lock pin can engage a recess of the housing assembly, the lock pin can miss the recess of the housing assembly and the vane can hit the chamber wall with a force that causes significant noise. This misalignment of the lock pin with the recess of the housing assembly and the noise associated with the vane hitting the chamber wall can be detrimental to phaser performance.

SUMMARY OF THE INVENTION

A switched cushion stop for a variable cam timing phaser of a variable cam timing system is disclosed. The cushion stop may be actively controlled by the spool valve or passively controlled.

The cushion stop of the embodiments of the present invention lower the impact forces between the rotor assembly and the housing assembly and slows the rotor assembly to allow the lock pin to engage with phasers that are designed to include overtravel. Overtravel occurs when the backlash is determined by the fit between lock pin outer diameter and recess width. In this case, the rotor assembly is preferably kept away from the housing assembly when the phaser is in the full advance and the lock pin is in the locked position so there is never a stack condition that occurs, where the housing assembly stops the rotor assembly before the lock pin is fully aligned with the recess.

DETAILED DESCRIPTION OF THE INVENTION

Figure 1:
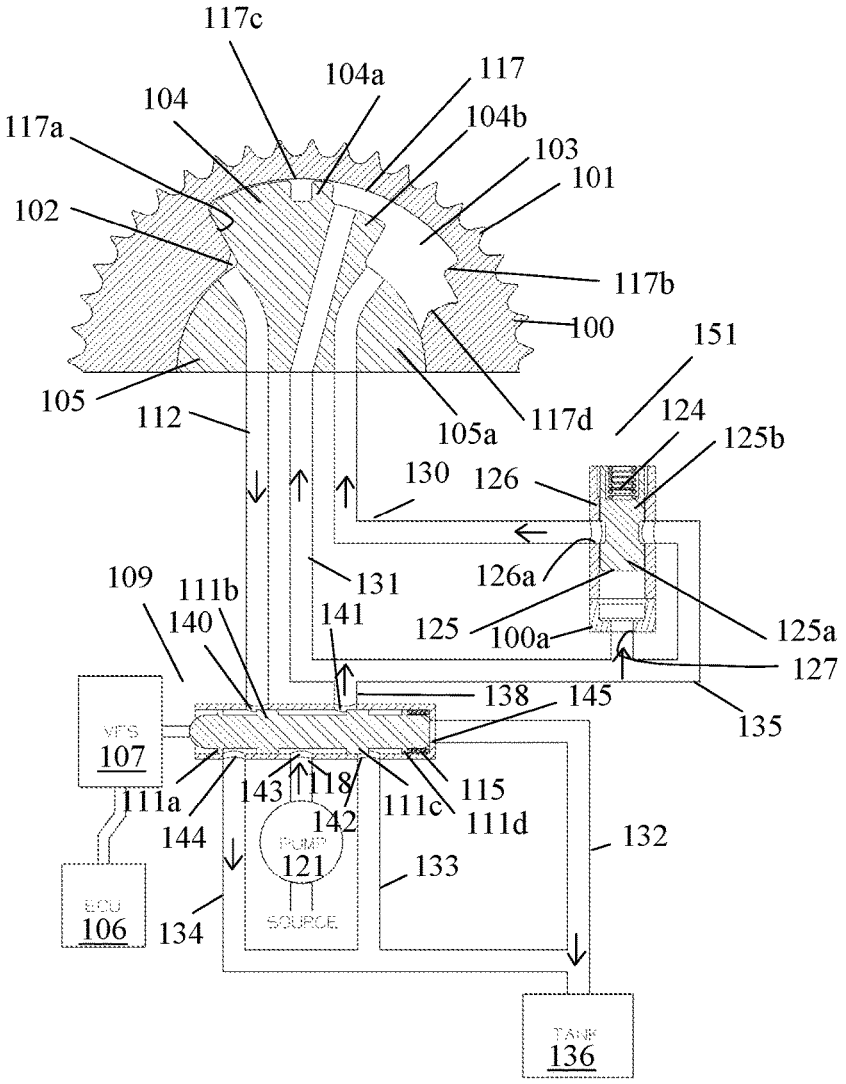
FIG. 1 shows a schematic of a phaser of a first embodiment with the phaser in the full retard position with the lock pin of the lock pin valve in an unlocked position.

Internal combustion engines have employed various mechanisms to vary the angle between the camshaft and the crankshaft for improved engine performance or reduced emissions. The majority of these variable camshaft timing (VCT) mechanisms use one or more "vane phasers" on the engine camshaft (or camshafts, in a multiple-camshaft engine). In most cases, the phasers have a rotor assembly 105 with one or more vanes 104, mounted to the end of the camshaft (not shown), surrounded by a housing assembly 100 with the vane chambers into which the vanes fit. It is possible to have the vanes 104 mounted to the housing assembly 100, and the chambers in the rotor assembly 105, as well. The housing's outer circumference 101 forms the sprocket, pulley or gear accepting drive force through a chain, belt, or gears, usually from the crankshaft, or possible from another camshaft in a multiple-cam engine.

As shown in FIGS. 1-4, the housing assembly 100 of the phaser has an outer circumference 101 for accepting drive force as well as a first end plate 100*a* and a second end plate (not shown). A bias spring may be present between the housing assembly and the rotor assembly. The bias spring preferably biases the rotor assembly 105 towards an advance position, however, the bias spring can bias the rotor assembly 105 towards the retard position. The rotor assembly 105 is connected to the camshaft (not shown) and is coaxially located within the housing assembly 100. The rotor assembly 105 has a body 105*a* with at least one vane 104 extending therefrom. The at least one vane 104 separating a chamber 117 formed between the housing assembly 100 and the rotor assembly 105 into an advance chamber 102 and a retard chamber 103. The chamber 117 has an advance wall 117*a*, and a retard wall 117*b* separated by an arc 117*c* with an arc length. The vane 104 has a body 104*a* which extends a length from the body 105*a* of the rotor assembly 105 and slides relative to the arc 117*c* of the chamber 117. The body 104*a* of the vane 104 has a protrusion or step 104*b* extending laterally from the body 104*a*. The protrusion 104*b* of the body 104*a* of the vane 104 does not contact or slide relative to the arc 117*c* of the chamber 117. The retard wall 117*b* has a recess 117*d* which can receive the protrusion 104*b* of the vane 104, such that the body 104*a* of the vane 104 is adjacent and directly contacts the retard wall 117*b*. The vane 104 is capable of rotation to shift the relative angular position of the housing assembly 100 and the rotor assembly 105.

The rotor assembly 105 additionally contains at least an advance line 112 connecting the advance chamber 102 to a control valve 109, a retard line 131 connecting the retard chamber 103 to the control valve 109, a lock pin valve 151, and a cushion stop line 130 in fluid communication with the lock pin valve 151.

The lock pin valve 151 includes a sleeve 126 received within a bore (not shown) of the vane 104. Slidably received within the sleeve 126 is a lock pin 125 with cylindrical lands 125*a* and 125*b*. The lock pin 125 is biased by a lock pin spring 124 to engage a recess 127 in the end plate 100*a* of the housing assembly 100. The sleeve 126 contains a port 126*a* connected to cushion stop line 130 and line 135. The lock pin 125 is moveable between a locked position in which the lock pin 125 engages a first end plate 100*a* of the housing assembly 100 and an unlocked position in which the lock pin 125 does not engage the first end plate 100*a*. In the unlocked position, fluid can flow between cylindrical lands 125*a* and 125*b* of the lock pin 125 and through port 126*a* of the sleeve 126.

The control valve 109, preferably a spool valve, includes a spool 111 with cylindrical lands 111*a*, 111*b*, 111*c*, and 111*d*, slidably received in a sleeve 116 within a bore in the rotor assembly 105 and pilots in the camshaft (not shown). The control valve 109 may be located remotely from the phaser, within a bore in the rotor assembly 105 which pilots in the camshaft, or in a center bolt of the phaser. One end of the spool 111 contacts spring 115 and the opposite end of the spool 111 contacts a pulse width modulated variable force solenoid (VFS) 107. The solenoid 107 may also be linearly controlled by varying current or voltage or other methods as applicable. Additionally, the opposite end of the spool 111 may contact and be influenced by a motor, or other actuators.

The sleeve 116 of the control valve 109 has a series of ports 140-144 and a vent orifice 145. The orifice 145 may be used to allow any fluid that might have gotten behind spool land 111*d* to exhaust to tank 136. Port 140 is connected to advance line 112 and in fluid communication with the advance chamber 102. Port 141 is connected to line 138 which splits into a retard line 131 in fluid communication with retard chamber 103 and line 135 in fluid communication with lock pin valve 151. Port 142 is connected to an exhaust line 133 and tank 136. Port 143 is connected to an inlet line 118 which is fed supply fluid via a pump 121. Port 144 is connected to exhaust line 134 and tank 136. Vent orifice 145 is in communication with tank 136 via line 132.

The position of the control valve 109 is controlled by an engine control unit (ECU) 106 which controls the duty cycle of the variable force solenoid 107. The ECU 106 preferably includes a central processing unit (CPU) which runs various computational processes for controlling the engine, memory, and input and output ports used to exchange data with external devices and sensors. Further detail regarding control of the phaser is discussed in detail below. The position of the spool 111 controls the motion (e.g. to move towards the advance position, retard position or full advance position) of the phaser as well as whether the lock pin 125 of the lock pin valve 151 is moved to locked position or an unlocked position.

Based on the duty cycle of the pulse width modulated variable force solenoid 107, the spool 111 moves to a corresponding position along its stroke. When the duty cycle of the variable force solenoid 107 is approximately 40%, 40% to 60% or 80%, the spool 111 will be moved to positions that correspond to moving the phase to the advance position hold position, retard position respectively.

FIG. 1 shows the phaser in a full retard position. To move towards the retard position, the duty cycle is adjusted to 60%, the force of the VFS 107 on the spool 111 is changed and the spool 111 is moved to the right in a retard mode in the figure by the VFS 107, until the force of spring 115 balances the force of the VFS 107. In this position, fluid in the advance chamber 102 exits the advance chamber 102 through the advance line 112. From line 112, fluid flows through port 140 and between spool lands 111*a* and 11*b* to line 134 through port 144. From line 134, fluid flows to tank 136.

Fluid from the pump 121 flows to inlet line 118 and enters the control valve 109 through port 143 and between spool lands 111*b* and 111*c*. Fluid from the control valve 109 flows to line 138 from port 141. Line 138 splits into line 135 and the retard line 131. Fluid from line 135 biases the lock pin 125 against the lock pin spring 124, such that the lock pin 125 is moved to an unlocked position. Fluid also flows through the sleeve port 126*a* of the lock pin valve 151 and between lock pin lands 125*a* and 125*b* to cushion stop line 130. From the cushion stop line 130 fluid flows to the retard chamber 103. Fluid also flows into the retard chamber 103 from retard line 131. In the full retard position of the phaser, both the retard line 131 and the cushion stop line 130 are exposed to the retard chamber 103.

Figure 2:
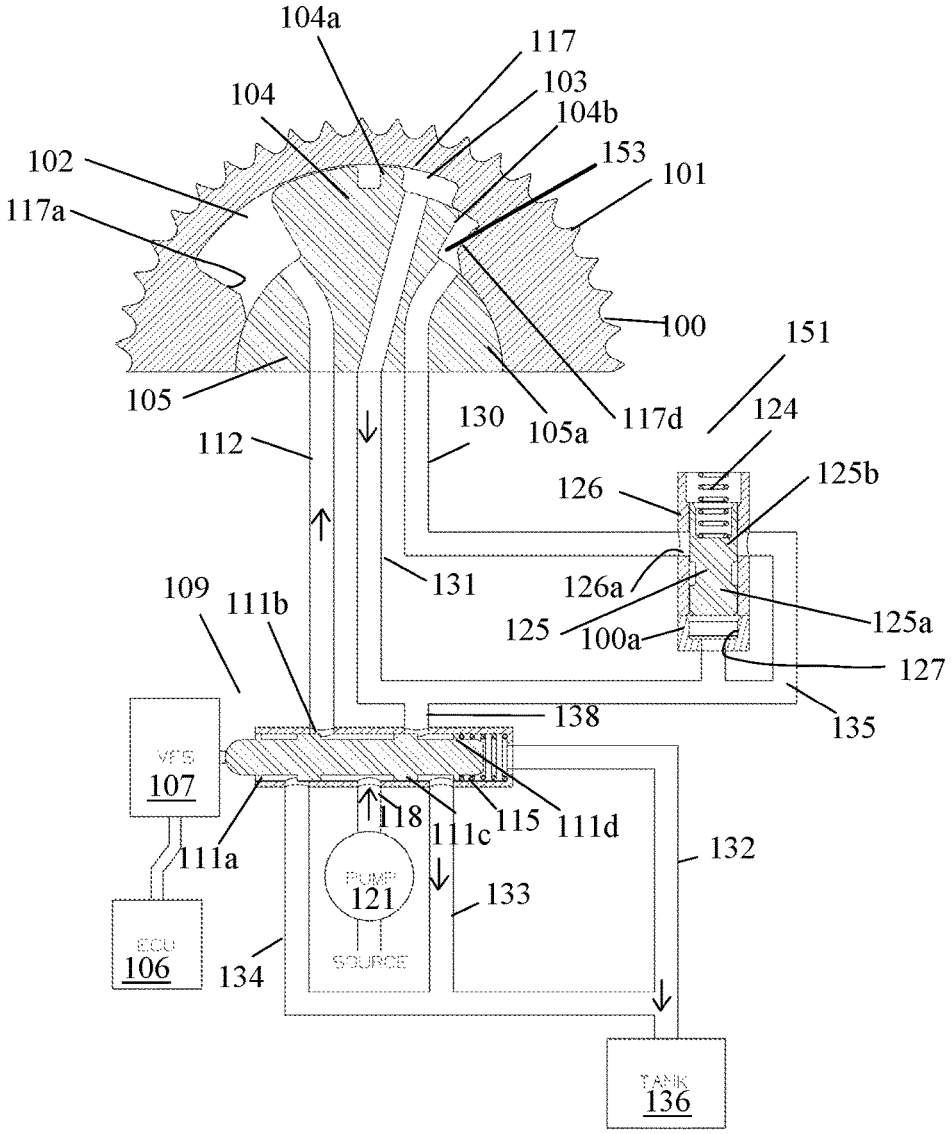
FIG. 2 shows a schematic of the phaser of the first embodiment with the phaser in an advanced position with the lock pin of the lock pin valve returning to a locked position and a cushioned stop present between the housing assembly and the vane.

FIG. 2 shows the phaser moving towards an advance position with the lock pin returning to a locked position. To move towards the advance position, the duty cycle is adjusted to less than 60%, the force of the VFS 107 on the spool 111 is changed and the spool 111 is moved to the left in the figure by the spring 115, until the force of spring 115 balances the force of the VFS 107. In this position, fluid in the retard chamber 103 exits through the retard line 131. From retard line 131, fluid flows through port 141 and between spool lands 111*c* and 111*d* to line 133 through port 144 and to tank 136.

Fluid from the pump 121 flows to inlet line 118 and enters the control valve 109 through port 143 and between spool lands 111*b* and 111*c*. Fluid from the control valve 109 flows to advance line 112 from port 140. From the advance line 112, fluid flows into the advance chamber 102.

As fluid enters the advance chamber 102 and exits the retard chamber 103, the vane 104 is shifted towards the retard wall 117*b*. The protrusion 104*b* of the vane 104, the housing assembly 100, and the recess 117*d* of the retard wall 117*b* forms a cushion pocket 152 in which fluid can accumulate or become trapped and cushions the impact of the vane 104 with the retard wall 117*b* and prevents the vane 104 from engaging the retard wall 117*b* and the phaser moving to a full retard position. The cushion pocket 152 is in fluid communication with the cushion stop line 130. Fluid in the cushion pocket 152 can flow through the cushion stop line 130, to the sleeve port 126*a* and through the lock pin lands 125*a* and 125*b* until the lock pin 125 begins to move towards the recess 127 of the housing assembly 100 and lock pin land 125*b* blocks sleeve port 126*a*.

At the same time, fluid from pump 121 is prevented from flowing to line 135 via line 138 by spool land 111*c*. Fluid in line 135 can flow through port 141 and between spool lands 111*c* and 111*d* to exhaust to line 133 and tank 136. As the pressure of fluid in line 135 decreases, the lock pin spring 124 will bias the lock pin 125 towards the recess 127 of the housing assembly 100. The lock pin 125 cannot be moved to a locked position until the vane 104 is rotated into a full retard position and the lock pin 125 in the vane 104 is aligned with recess 127 of the housing assembly 100.

In order to allow the lock pin 125 to engage the recess 127 of the housing assembly 100, the rotor assembly 105 rotates the vane 104 to a full advance position, the fluid present in the cushion pocket 152 between the recess 117*d* of the retard wall 117*b*, the housing assembly 100, and the protrusion 104*b* of the vane 104 leaks out to the retard chamber 103 at an interface 153 between the protrusion 104*b* and the housing assembly 100. Additionally, another leak path could be present as an orifice, groove, restricted hole or worm trail in lock pin land 125*b*. The amount of restriction of the groove in the lock pin land 125*b* may be varied and would control how quickly the lock pin 125 is moved to a locked position. Fluid which leaks to the retard chamber 103 or fluid that leaks through lock pin land 125*b* all flows through the control valve 109 to tank 136.

Figure 3:
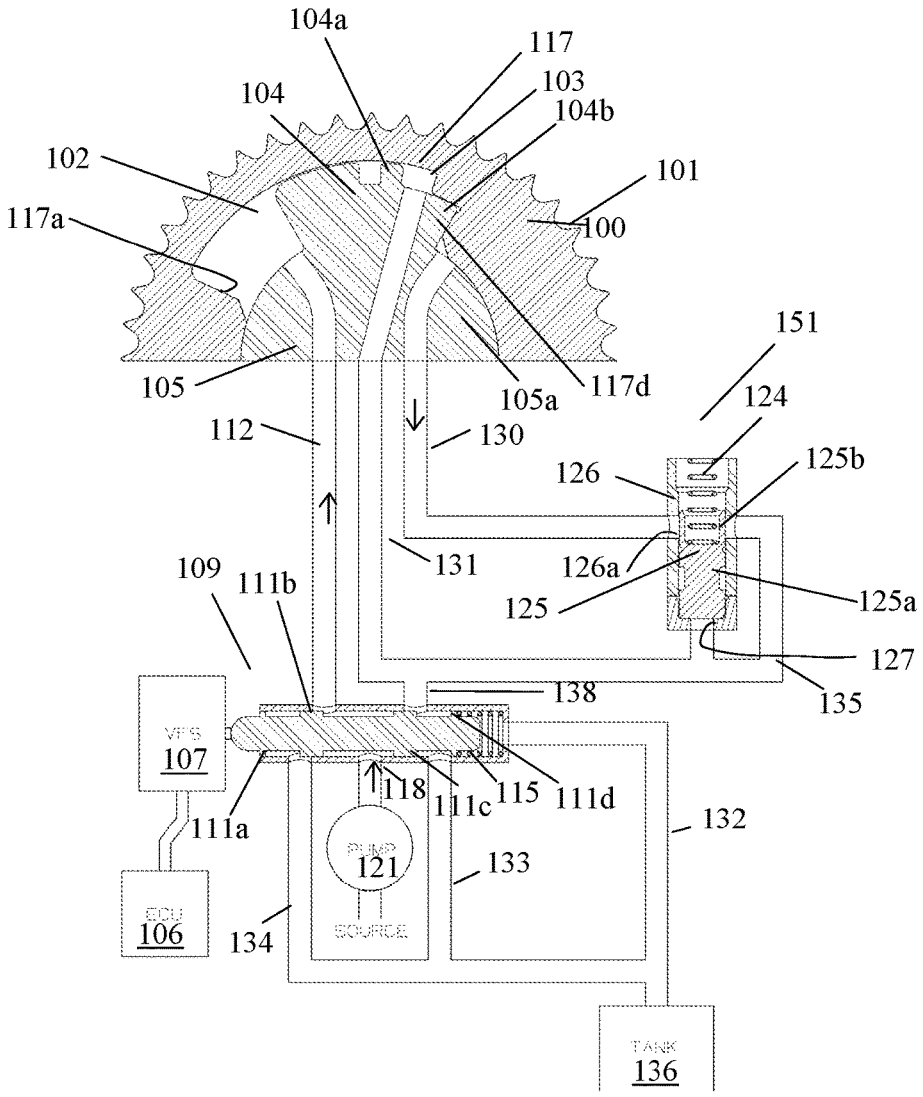
FIG. 3 shows a schematic of the phaser of the first embodiment with the phaser in the full advance position with the lock pin of the lock pin valve in the locked position.

FIG. 3 shows the phaser in a full advance position with the lock pin of the lock pin valve in a locked position. The full advance position is a position in which the protrusion 104*b* of the vane 104 is adjacent and directly contacts the recess 117*d* and the vane 104 contacts the retard wall 117*b* and a cushion pocket 152 is no longer present between the protrusion 104*b* and the recess 117*d* of the retard wall 117*b*. The fluid vacates the cushion pocket 152 through leakage at the interface 153 between the protrusion 104*b* and the housing assembly 100. Additionally, leak paths may also be present as described above. In the full advance position, the lock pin 125 can engage the recess 127 of the housing assembly 100, locking the movement of the rotor assembly 105 relative to the housing assembly 100. Fluid may be provided by pump 121 to the control valve 109 between spool lands 111*b* and 111*c* and to the advance chamber 102 via the advance line 112. Fluid from pump 121 is blocked from entering the retard chamber 103 from inlet line 118 by spool land 111*c*.

Similarly, fluid from pump 121 is additionally blocked from entering line 135 via line 135 leading to the lock pin 125 by spool land 111*c*.

Figure 4:
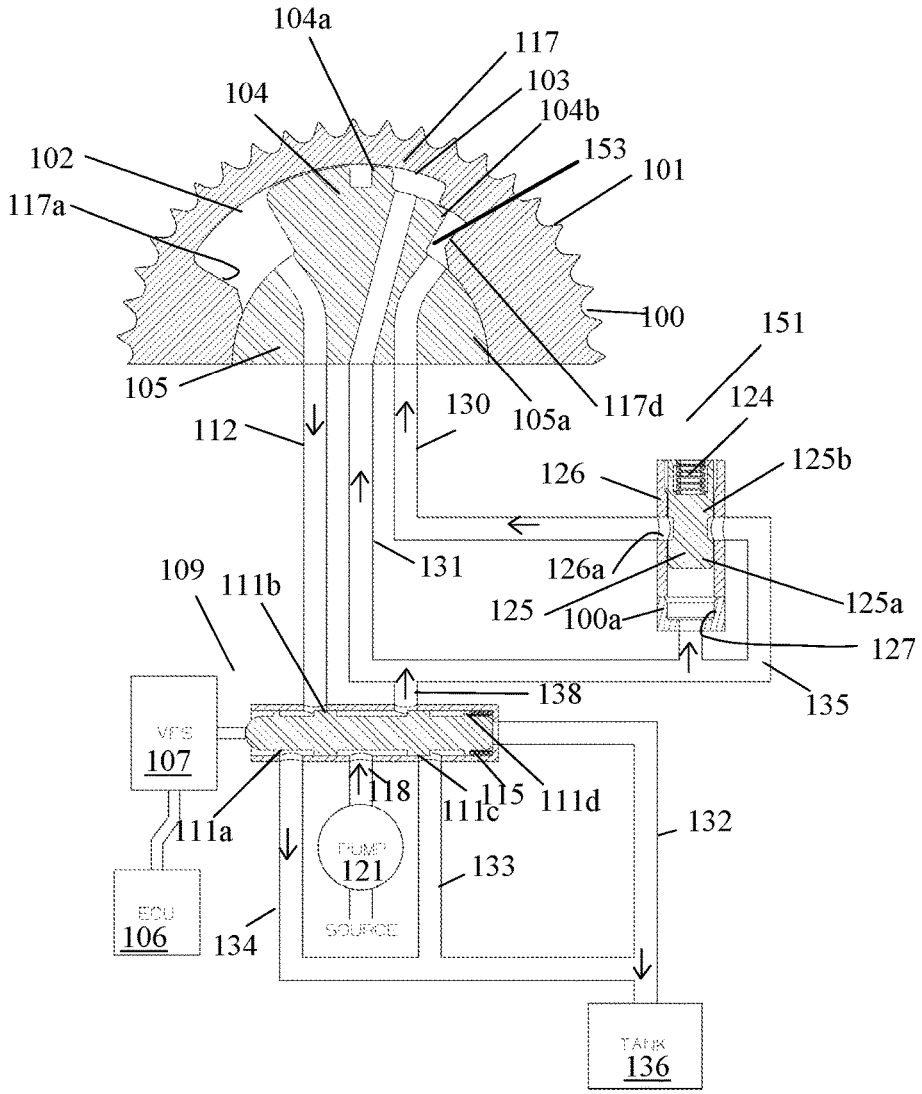
FIG. 4 shows a schematic of the phaser of the first embodiment with the phaser in the advance position with the lock pin of the lock pin valve leaving the locked position.

In order to leave the locked position at advance, the duty cycle is adjusted to greater than 60%, the force of the VFS 107 on the spool 111 is changed and the spool 111 is moved to the right in the FIG. 4 by the VFS 107, until the force of spring 115 balances the force of the VFS 107. As shown in FIG. 4, in this position, fluid in the advance chamber 102 exits through the advance line 112. From line 112, fluid flows through port 140 and between spool lands 111*a* and 111*b* to line 134 through port 144. From line 134, fluid flows to tank 136. Fluid from pump 121 flows to inlet line 118 and enters the control valve 109 through port 143 and between spool lands 111*b* and 111*c*. Fluid from inlet line 118 flows to line 138 from port 141. From line 138, fluid flows to line 135 and biases the lock pin 125 against the lock pin spring 124, such that the lock pin 125 is moved to an unlocked position. Fluid flows through the port 126*a* of sleeve 126 and between lock pin lands 125*a* and 125*b* to cushion stop line 130 and to the retard chamber 103. Fluid also flows into the retard chamber 103 from retard line 131 via line 138. As fluid flows to the retard chamber 103, the vane 104 is biased away from the retard wall 117*b* and towards the advance wall 117*a*.

FIGS. 5-9 show a phaser of a second embodiment of the present invention.

The housing assembly 200 of the phaser has an outer circumference 202 for accepting drive force as well as a first end plate 200*a* and a second end plate (not shown). A bias spring may be present between the housing assembly and the rotor assembly. The bias spring preferably biases the rotor assembly 205 towards an advance position, however, the bias spring can bias the rotor assembly 205 towards the retard position. The rotor assembly 205 is connected to the camshaft and is coaxially located within the housing assembly 200. The rotor assembly 205 has a body 205*a* with at least one vane 204 extending therefrom. The at least one vane 204 separating a chamber 217 formed between the housing assembly 200 and the rotor assembly 205 into an advance chamber 202 and a retard chamber 203. The chamber 217 has an advance wall 217*a*, and a retard wall 217*b* separated by an arc 217*c* with an arc length. The vane 204 has a body 204*a* which extends a length from the body 205*a* of the rotor assembly 205 and slides relative to the arc 217*c* of the chamber 217. The body 204*a* of the vane 204 has a protrusion or step 204*b* extending laterally from the body 204*a*. The protrusion 204*b* of the body 204*a* of the vane 204 does not contact or slide relative to the arc 217*c* of the chamber 217. The retard wall 217*b* has a recess 217*d* which can receive the protrusion 204*b* of the vane 204, such that the body 204*a* of the vane 204 is adjacent and directly contacts the retard wall 217*b*. The vane 204 is capable of rotation to shift the relative angular position of the housing assembly 200 and the rotor assembly 205.

The rotor assembly 205 additionally contains at least an advance line 212 connecting the advance chamber 202 to a control valve 209, a retard line 231 connecting the retard chamber 203 to the control valve 209, a lock pin 225, and a cushion stop line 230 in fluid communication with the lock pin 225.

The lock pin 225 is slidably received within a bore (not shown) of the vane 204. The lock pin 225 is biased by a lock pin spring 224 to engage a recess 227 in the first end plate 200*a* of the housing assembly 200. The lock pin 225 is moveable between a locked position in which the lock pin 225 engages a first end plate 200*a* of the housing assembly 200 and an unlocked position in which the lock pin 225 does not engage the first end plate 200*a*.

The control valve 209, preferably a spool valve, includes a spool 211 with cylindrical lands 211*a*, 211*b*, 211*c*, and 211*d*, slidably received in a sleeve 216 within a bore in the rotor assembly 205 and pilots in the camshaft (not shown). The control valve 209 may be located remotely from the phaser, within a bore in the rotor assembly 205 which pilots in the camshaft, or in a center bolt of the phaser. One end of the spool 211 contacts spring 215 and the opposite end of the spool 211 contacts a pulse width modulated variable force solenoid (VFS) 207. The solenoid 207 may also be linearly controlled by varying current or voltage or other methods as applicable. Additionally, the opposite end of the spool 211 may contact and be influenced by a motor, or other actuators.

The sleeve 216 of the control valve 209 has a series of ports 240-244 and a vent orifice 245. Port 240 is connected to advance line 212 in fluid communication with the advance chamber 202. Port 241 is connected to line 238 which splits into a retard line 231 in fluid communication with a retard chamber 203 and line 235 in fluid communication with a lock pin 225. Port 242 is connected to an exhaust line 233 and tank 236. Port 243 is connected to an inlet line 218 which is fed supply fluid via a pump 221. Port 244 is connected to exhaust line 234 and tank 236. Vent orifice 245 is in communication with tank 236 via line 232 and can alleviate any fluid which may leak within the sleeve and behind spool land 211*d*.

The position of the control valve 209 is controlled by an engine control unit (ECU) 206 which controls the duty cycle of the variable force solenoid 207. The ECU 206 preferably includes a central processing unit (CPU) which runs various computational processes for controlling the engine, memory, and input and output ports used to exchange data with external devices and sensors. Further detail regarding control of the phaser is discussed in detail below. The position of the spool 211 controls the motion (e.g. to move towards the advance position, holding position, or the retard position) of the phaser as well as whether the lock pin 225 is moved to a locked position or an unlocked position.

Based on the duty cycle of the pulse width modulated variable force solenoid 207, the spool 211 moves to a corresponding position along its stroke. When the duty cycle of the variable force solenoid 207 is approximately less 40%, 40% to 60% or greater than 60%, the spool 211 will be moved to positions that correspond to moving the phase to the advance position, hold position, retard position respectively.

Figure 5:
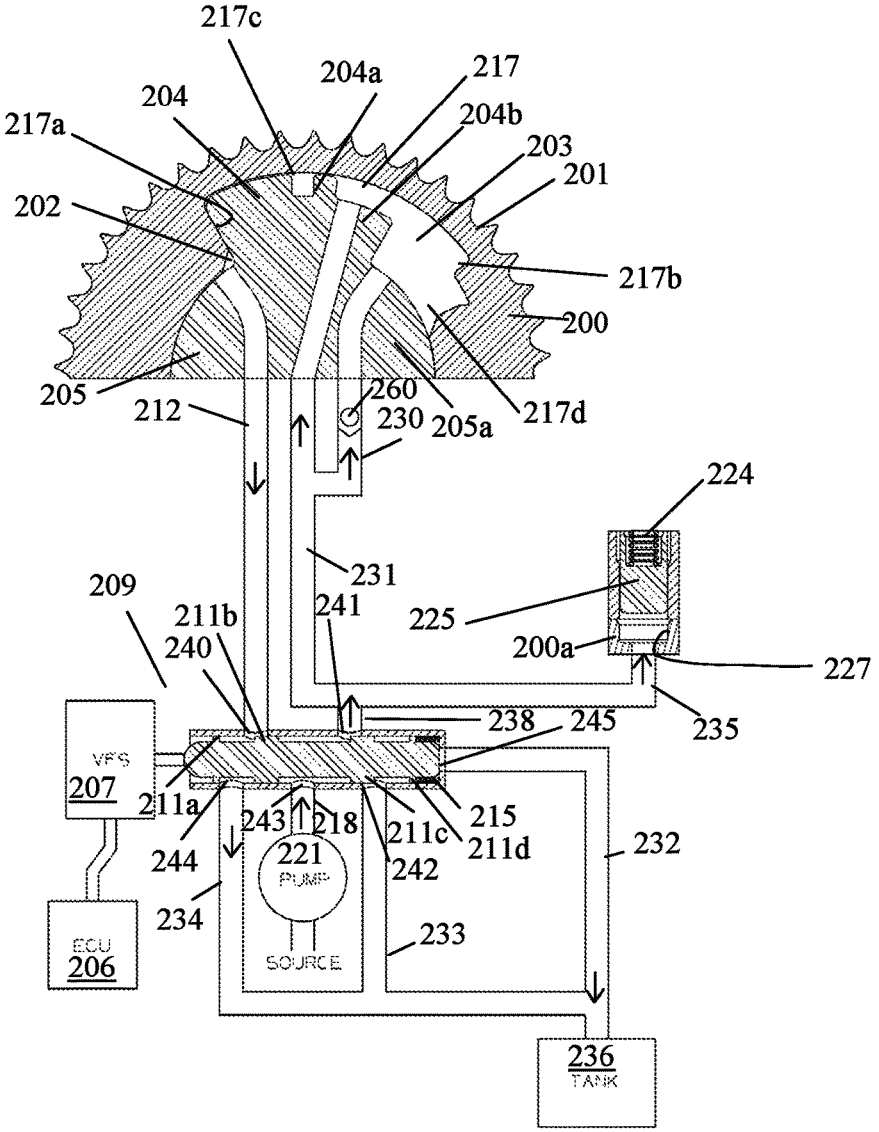
FIG. 5 shows a schematic of a phaser of a second embodiment with the phaser in the full retard position and the lock pin in an unlocked position.

FIG. 5 shows the phaser in a full retard position. To move towards the retard position, the duty cycle is adjusted to a range greater than 60%, the force of the VFS 207 on the spool 211 is changed and the spool 211 is moved to the right in a retard mode in the figure by the VFS 107, until the force of spring 215 balances the force of the VFS 207. In this position, fluid in the advance chamber 202 exits the advance chamber 202 through the advance line 212. From advance line 212, fluid flows through port 240 and between spool lands 211*a* and 211*b* to line 234 through port 244. From line 234, fluid flows to tank 236.

Fluid from pump 221 flows to an inlet line 218 and enters the control valve 209 through port 243 and between spool lands 211*b* and 211*c*. Fluid from the control valve 209 flows to line 238 from port 241. Line 238 splits into line 235 and the retard line 231. Fluid from line 235 biases the lock pin 225 against the spring 224, such that the lock pin 225 is moved to an unlocked position. Fluid flows into the retard chamber 203 from retard line 231. Additionally, fluid from retard line 231 flows into the cushion stop line 230 and through one-way valve 260. In the retard position, both the retard line 231 and the cushion stop line 230 are exposed to the retard chamber 203. The one-way valve 260 may be a ball check valve, band check valve or other one-way valve.

Figure 6:
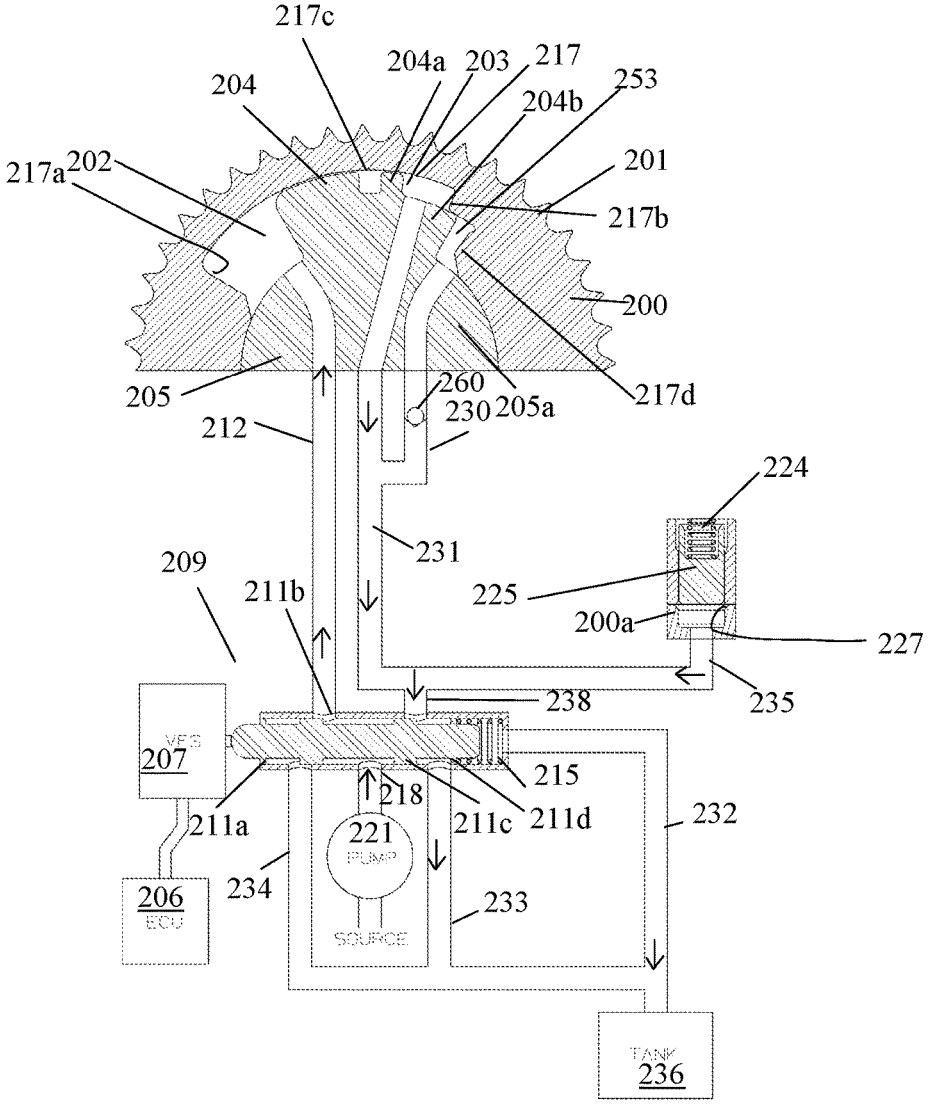
FIG. 6 shows a schematic of the phaser of the second embodiment with the phaser in an advanced position with the lock pin returning to a locked position and a cushioned stop present between the vane and the housing assembly.

FIG. 6 shows the phaser moving towards an advance position with the lock pin returning to a locked position. To move towards the advance position, the duty cycle is adjusted to a range less than 40%, the force of the VFS 207 on the spool 211 is changed and the spool 211 is moved to the left in the figure by the spring 215, until the force of spring 215 balances the force of the VFS 207. In this position, fluid in the retard chamber 203 exits the retard chamber 203 through the retard line 231. From retard line 231, fluid flows through port 241 and between spool lands 211*c* and 211*d* to exhaust line 233 through port 244 and to tank 236.

Fluid from a pump 221 flows to inlet line 218 and enters the control valve 209 through port 243 and between spool lands 211*b* and 211*c*. Fluid from the control valve 209 flows to advance line 212 from port 240. From the advance line 212, fluid flows into the advance chamber 202.

As fluid enters the advance chamber 202 and exits the retard chamber 203, the vane 204 is shifted towards the retard wall 217*b*. The protrusion 204*b* of the vane 204, the housing assembly 200, and the recess 217*d* of the retard wall 217*b* forms a cushion pocket 252 in which fluid can accumulate or become trapped and cushions the impact of the vane 204 with the retard wall 217*b* and prevents the vane 204 from engaging the retard wall 217*b* and the phaser moving to a full retard position. The cushion pocket 252 is in fluid communication with the cushion stop line 230. Fluid in the cushion pocket 252 can flow through the cushion stop line 230, but fluid is prevented from venting the cushion pocket 252 by one-way valve 260.

Fluid from pump 221 is prevented from flowing to line 235 via line 238 by spool land 211*c*. Fluid in line 235 can flow through port 241 and between spool lands 211*c* and 211*d* to exhaust to line 233 and tank 236. As the pressure of fluid in line 235 decreases, the lock pin spring 224 will bias the lock pin 225 towards the recess 227 of the housing assembly 200. The lock pin 225 cannot be moved to a locked position until the vane 204 is rotated into a full retard position and the lock pin 225 in the vane 204 is aligned with recess 227 of the housing assembly 200.

In order to allow the lock pin 225 to engage the recess 227 of the housing assembly 200, the rotor assembly 205 rotates the vane 204 to a full retard position, the fluid present in the cushion pocket 252 between the recess 217*d* of the retard wall 217*b*, the housing assembly 200, and the protrusion 204*b* of the vane 204 leaks out to the retard chamber 203 at an interface 253 between the protrusion 204*b* and the housing assembly 200. Fluid which leaks to the retard chamber 203 flows through the control valve 209 to tank 236 via exhaust line 233.

Figure 7:
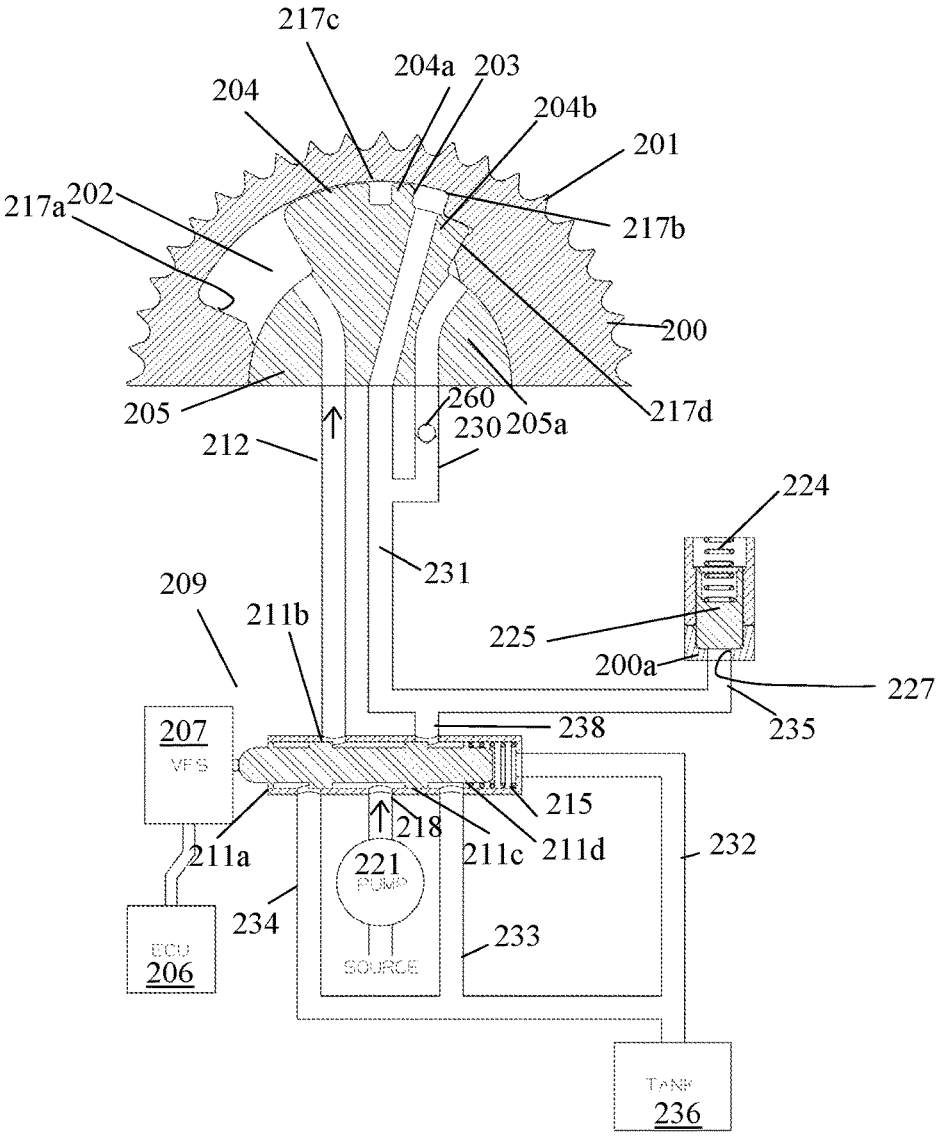
FIG. 7 shows a schematic of the phaser of the second embodiment with the phaser in the full advance position with the lock pin in the locked position.

FIG. 7 shows the phaser in a full advance position with the lock pin in a locked position. The full advance position is a position in which the protrusion 204*b* of the vane 204 is adjacent and directly contacts the recess 217*d* and the vane 204 contacts the retard wall 217*b* and a cushion pocket 252 is no longer present between the protrusion 204*b* and the recess 217*d* of the retard wall 217*b*. The fluid vacates the cushion pocket 252 through leakage at the interface 253 between the protrusion 204*b* and the housing assembly 200.

In the full advance position, the lock pin 225 can engage the recess 227 of the housing assembly 200, locking the movement of the rotor assembly 205 relative to the housing assembly 200. Fluid may be provided by pump 221 to the control valve 209 between spool lands 211*b* and 211*c* and to the advance chamber 202 via the advance line 212. Fluid from pump 221 is blocked from entering the retard chamber 203 from inlet line 218 by spool land 211*c*. Similarly, fluid from pump 221 is additionally blocked from entering line 235 via line 235 leading to the lock pin 225 by spool land 211*c*.

Figure 8:
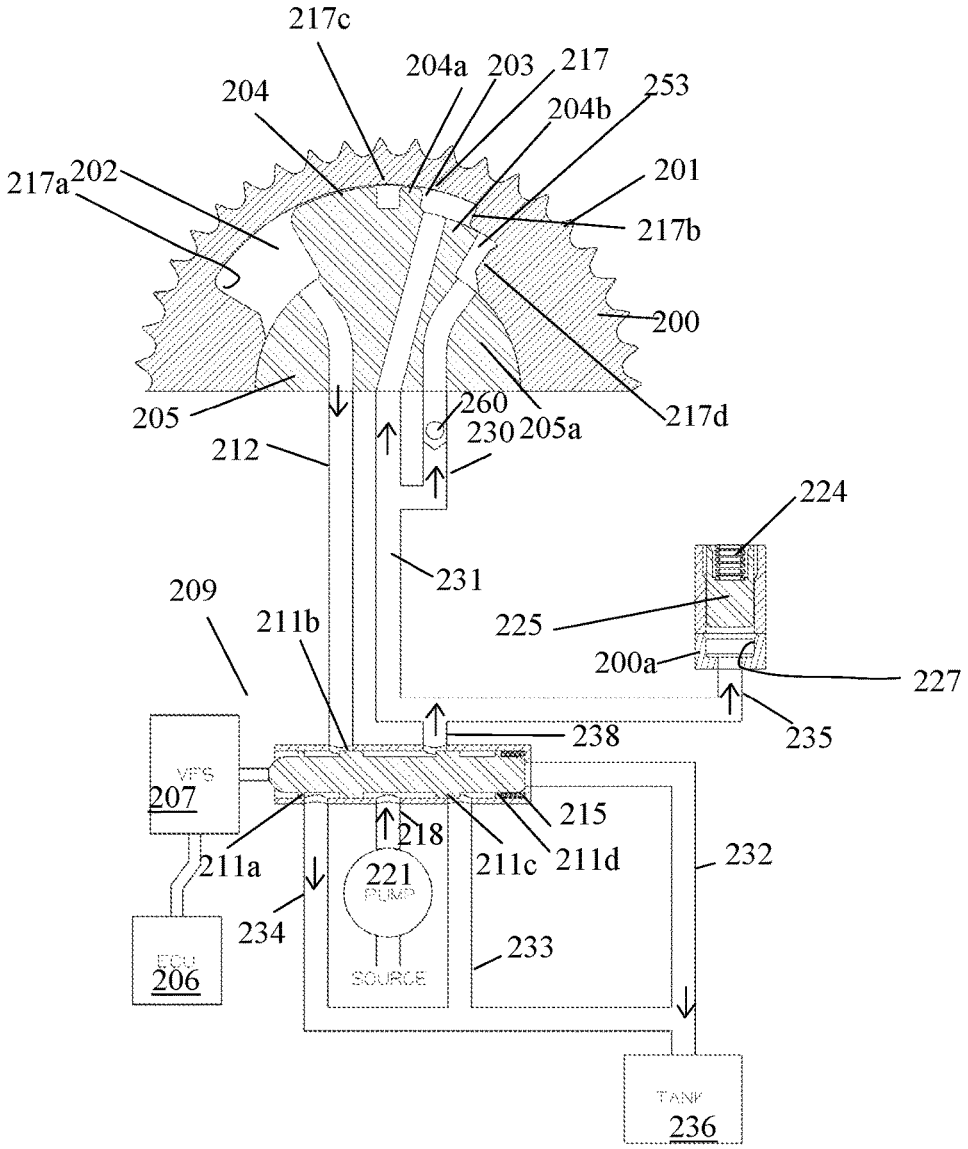
FIG. 8 shows a schematic of the phaser of the second embodiment with the phaser in advance position with the lock pin leaving the locked position.

In order to leave the locked position at advance, the duty cycle is adjusted to a range greater than 60%, the force of the VFS 207 on the spool 211 is changed and the spool 211 is moved to the right in FIG. 8 by the VFS 207, until the force of spring 215 balances the force of the VFS 207. As shown in FIG. 8, in this position, fluid in the advance chamber 202 exits the advance chamber 202 through the advance line 212. From line 212, fluid flows through port 240 and between spool lands 211*a* and 211*b* to line 234 through port 244. From line 234, fluid flows to tank 236.

Fluid from pump 221 flows to inlet line 218 and enters the control valve 209 through port 243 and between spool lands 211*b* and 211*c*. Fluid from inlet line 218 flows to line 238 from port 241. From line 238, fluid flows to line 235 and biases the lock pin 225 against the lock pin spring 224, such that the lock pin 225 is moved to an unlocked position. Fluid flows into the retard chamber 203 from retard line 231. Fluid additionally flows from the retard line 231 to the cushion stop line 230, through the one-way valve 260 and into the retard chamber 203. As fluid flows to the retard chamber 203, the vane 204 is biased away from the retard wall 217*b* and towards the advance wall 217*a*.

FIGS. 9-12 show a phaser of a third embodiment of the present invention.

The housing assembly 300 of the phaser has an outer circumference 301 for accepting drive force as well as a first end plate 300*a* and a second end plate (not shown). A bias spring may be present between the housing assembly and the rotor assembly. The bias spring preferably biases the rotor assembly 305 towards an advance position, however, the bias spring can bias the rotor assembly 305 towards the retard position. The rotor assembly 305 is connected to the camshaft and is coaxially located within the housing assembly 300. The rotor assembly 305 has a body 305*a* with at least one vane 304 extending therefrom. The at least one vane 304 separating a chamber 317 formed between the housing assembly 300 and the rotor assembly 305 into an advance chamber 302 and a retard chamber 303. The chamber 317 has an advance wall 317*a*, and a retard wall 317*b* separated by an arc 317*c* with an arc length. The vane 304 has a body 304*a* which extends a length from the body 305*a* of the rotor assembly 305 and slides relative to the arc 317*c* of the chamber 317. The body 304*a* of the vane 304 has a protrusion or step 304*b* extending laterally from the body 304*a*. The protrusion 304*b* of the body 304*a* of the vane 304 does not contact or slide relative to the arc 317*c* of the chamber 317. The retard wall 317*b* has a recess 317*d* which can receive the protrusion 304*b* of the vane 304, such that the body 304*a* of the vane 304 is adjacent and directly contacts the retard wall 317*b*. The vane 304 is capable of rotation to shift the relative angular position of the housing assembly 300 and the rotor assembly 305.

The rotor assembly 305 additionally contains an advance line 312 connecting the advance chamber 302 to a control valve 309, a retard line 331 connecting the retard chamber 303 to the control valve 309 and in fluid communication with the lock pin 325, and a cushion stop line 330 in fluid communication with the retard chamber 303.

The lock pin 325 is slidably received within a bore (not shown) of the vane 304. The lock pin 325 is biased by a lock pin spring 324 to engage a recess 327 in the first end plate 300*a* of the housing assembly 300. The lock pin 325 is moveable between a locked position in which the lock pin 325 engages a first end plate 300*a* of the housing assembly 300 and an unlocked position in which the lock pin 325 does not engage the first end plate 300*a*.

The control valve 309, preferably a spool valve, includes a spool 311 with cylindrical lands 311*a*, 311*b*, 311*c*, 311*d*, and 311*e*, slidably received in a sleeve 316 within a bore in the rotor assembly 305 and pilots in the camshaft (not shown). The control valve 309 may be located remotely from the phaser, within a bore in the rotor assembly 305 which pilots in the camshaft, or in a center bolt of the phaser. One end of the spool 311 contacts spring 315 and the opposite end of the spool 311 contacts a pulse width modulated variable force solenoid (VFS) 307. The solenoid 307 may also be linearly controlled by varying current or voltage or other methods as applicable. Additionally, the opposite end of the spool 311 may contact and be influenced by a motor, or other actuators.

The sleeve 316 of the control valve 309 has a series of ports 340-346. Port 340 is connected to advance line 312 in fluid communication with the advance chamber 302. Port 341 is connected to line 338 which splits into retard line 331 in fluid communication with a retard chamber 303 and line 335 in fluid communication with lock pin 325. Port 342 is connected to the cushion stop line 330 and the retard chamber 302. Port 343 is connected to line 339 and inlet line 318. Port 344 is connected to exhaust line 333 which is connected to tank 346. Port 345 is connected to inlet line 318 which is fed supply fluid via a pump 321. Port 346 is connected to exhaust line 334 and tank 336. Vent orifice 347 is in communication with tank 336 via line 332.

The position of the control valve 309 is controlled by an engine control unit (ECU) 306 which controls the duty cycle of the variable force solenoid 307. The ECU 306 preferably includes a central processing unit (CPU) which runs various computational processes for controlling the engine, memory, and input and output ports used to exchange data with external devices and sensors. Further detail regarding control of the phaser is discussed in detail below.

The position of the spool 311 controls the motion (e.g. move towards the phase to the retard position, advance position, and full advance position) of the phaser as well as whether the lock pin 325 is in a locked position or unlocked position.

Based on the duty cycle of the pulse width modulated variable force solenoid 307, the spool 311 moves to a corresponding position along its stroke.

When the duty cycle of the variable force solenoid 307 is approximately less than 10%, 10% to 40%, 40% to 60%, or greater than 60%, the spool 111 will be moved to positions that correspond to moving the phase to the advance position with cushion, varying level of cushion with an advance position, hold position, retard position respectively.

Figure 9:
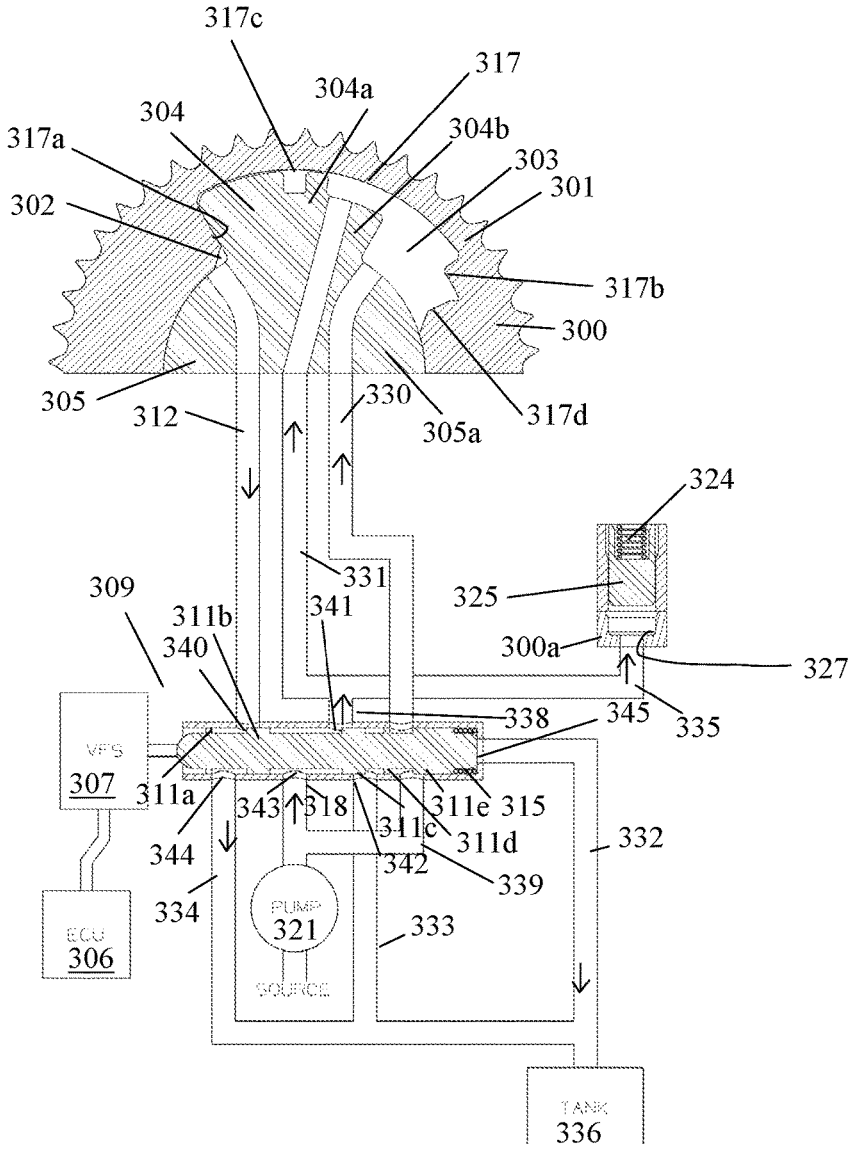
FIG. 9 shows a schematic of a phaser of a third embodiment with the phaser in the full retard position and the lock pin in an unlocked position.

FIG. 9 shows the phaser in a full retard position. To move towards the retard position, the duty cycle is adjusted to a range greater than 60%, the force of the VFS 307 on the spool 311 is changed and the spool 311 is moved to the right in a retard mode in the figure by the VFS 307, until the force of spring 315 balances the force of the VFS 307. In this position, fluid in the advance chamber 302 exits the advance chamber 302 through the advance line 312. From line 312, fluid flows through port 340 and between spool lands 311*a* and 311*b* to exhaust line 334 through port 346. From exhaust line 334, fluid flows to tank 336.

Fluid from a pump 321 flows to an inlet line 318 and enters the control valve 309 through port 345 and between spool lands 311*b* and 311*c*. Fluid from the control valve 309 flows through port 341 to line 338. From line 338, fluid flows to both line 335 and the retard line 331. Fluid from line 335 biases the lock pin 325 against the lock pin spring 324, such that the lock pin 325 is moved to an unlocked position. Fluid flows into the retard chamber 303 from retard line 331.

Fluid from inlet line 318 flows to line 350, through port 343, between spool lands 311*d* and 311*e*. From the control valve 309 fluid flows to the cushion stop line 330 and the retard chamber 303 via port 342. In the retard position, both the retard line 331 and the cushion stop line 330 are exposed to the retard chamber 303.

Figure 10:
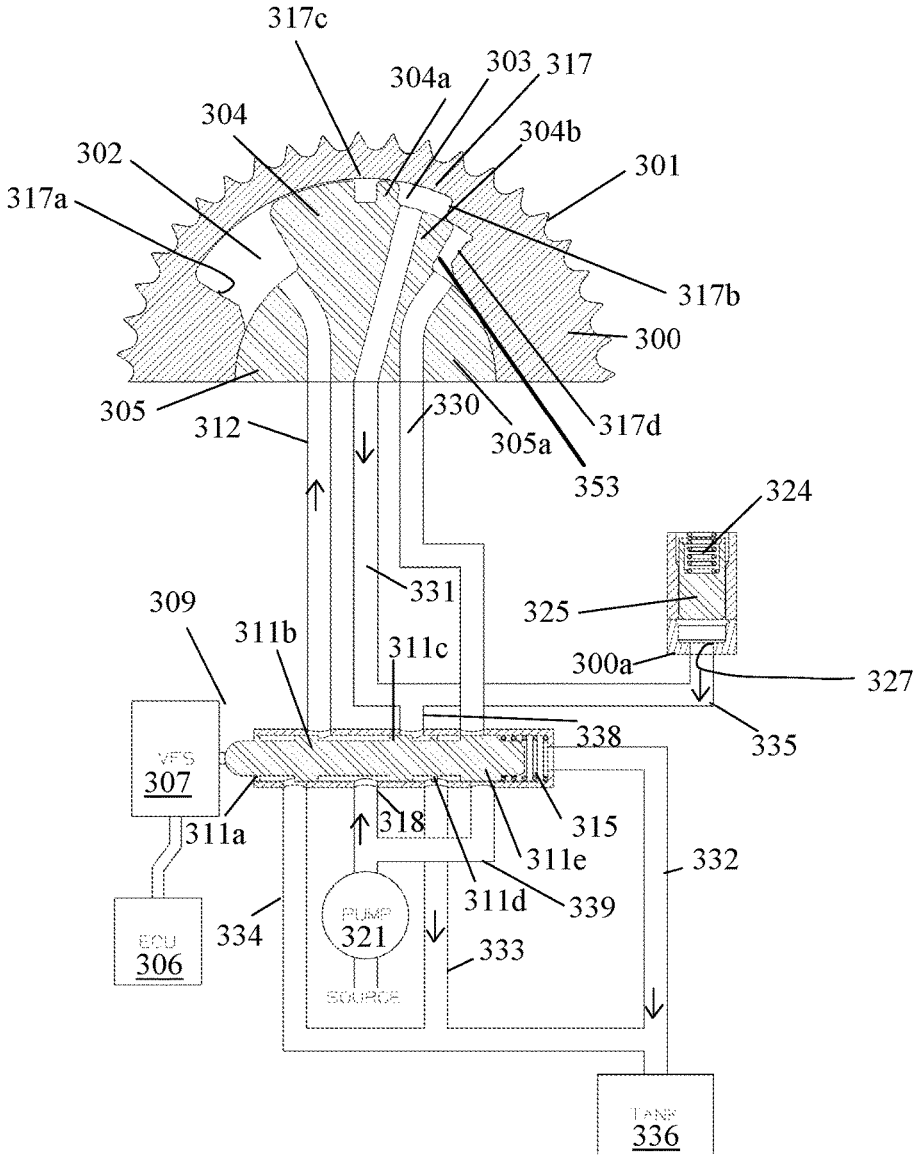
FIG. 10 shows a schematic of the phaser of the third embodiment with the phaser in an advanced position with the lock pin returning to a locked position and a cushioned stop present between the vane and the housing assembly.

FIG. 10 shows the phaser moving towards an advance position with the lock pin returning to a locked position. To move towards the advance position, the duty cycle is adjusted to a range less than 40%, the force of the VFS 307 on the spool 311 is changed and the spool 311 is moved to the left in the figure by the spring 315, until the force of spring 315 balances the force of the VFS 307. In this position, fluid in the retard chamber 303 exits the retard chamber 303 through the retard line 331. From retard line 331, fluid flows through port 341 and between spool lands 311*c* and 311*d* to exhaust line 333 through port 344 and to tank 336.

Fluid from a pump 321 flows to an inlet line 318 and enters the control valve 309 through port 345 and between spool lands 311*b* and 311*c*. Fluid from the control valve 309 flows to advance line 312 from port 340. From the advance line 312, fluid flows into the advance chamber 302.

As fluid enters the advance chamber 302 and exits the retard chamber 303, the vane 304 is shifted towards the retard wall 317*b*. The protrusion 304*b* of the vane 304, the housing assembly 300, and the recess 317*d* of the retard wall 317*b* forms a cushion pocket 352 in which fluid can accumulate or become trapped and cushions the impact of the vane 304 with the retard wall 317*b* and prevents the vane 304 from engaging the retard wall 317*b* and the phaser moving to a full retard position. The cushion pocket 352 is in fluid communication with the cushion stop line 330. Fluid in the cushion pocket 352 can flow through the cushion stop line 330, but fluid is prevented from venting from the cushion stop line 330 by spool land 311*e*.

Fluid from pump 321 is prevented from flowing to line 335 by spool land 311*c*. Fluid in line 335 can flow through port 341 and between spool lands 311*c* and 311*d* to exhaust line 333 and tank 336. As the pressure of fluid in line 335 decreases, the lock pin spring 324 will bias the lock pin 325 towards the recess 327 of the housing assembly 100. The lock pin 325 cannot be moved to a locked position until the vane 304 is rotated into a full retard position and the lock pin 325 in the vane 304 is aligned with recess 327 of the housing assembly 300.

In order to allow the lock pin 325 to engage the recess 327, and the rotor assembly 305 to rotate the vane 304 to a full retard position, the fluid present in the cushion pocket 352 between the recess 317*d* of the retard wall 317*b*, the housing assembly 300, and the protrusion 304*b* of the vane 304 leaks out to the retard chamber 303 at an interface 353 between the protrusion 304*b* and the housing assembly 300. Fluid which leaks to the retard chamber 303 flows through the control valve 309 to tank 336 via retard line 331.

Figure 11:
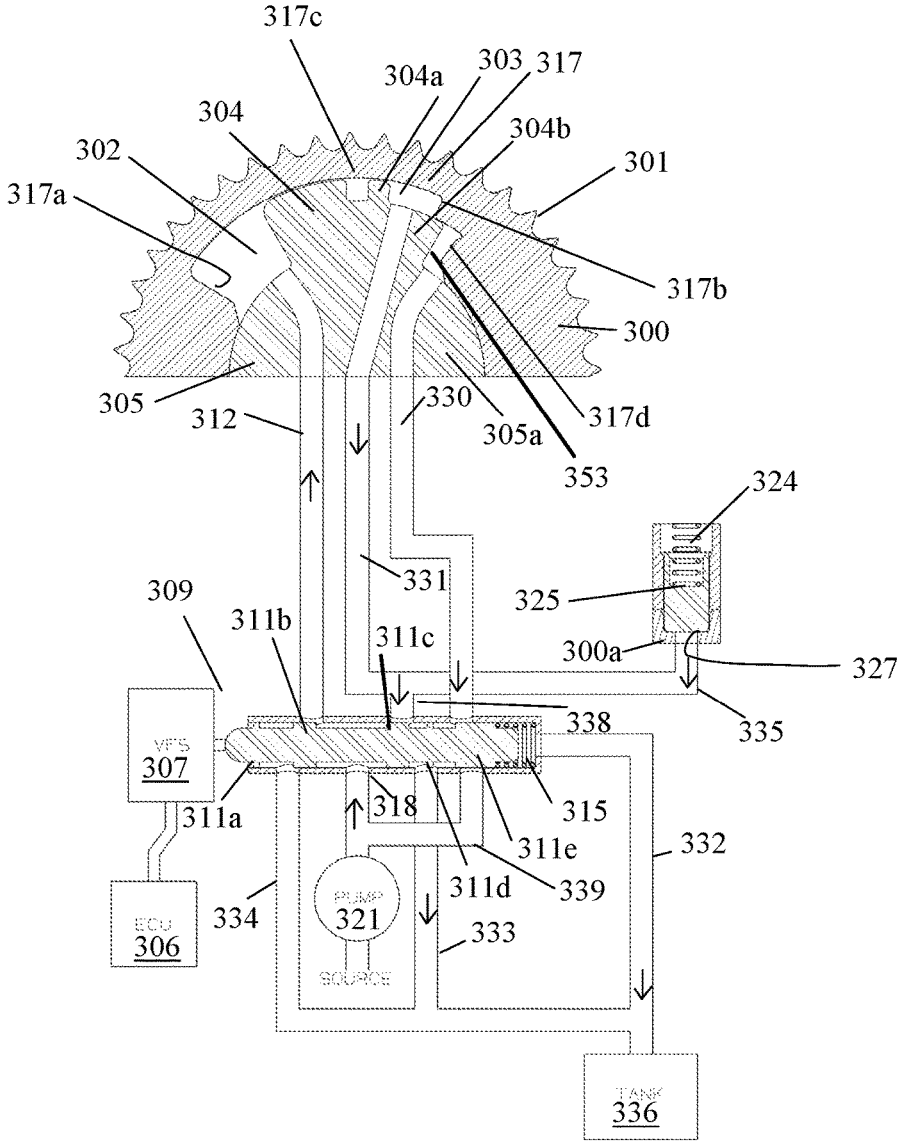
FIG. 11 shows a schematic of the phaser of the third embodiment with the phaser in an advanced position with the cushion stop being metered as the lock pin returns to a locked position.

FIG. 11 shows a schematic of the phaser moving towards an advance position with the lock pin returning to a locked position but with spool controlled metering of the return of the lock pin to the locked position.

To move towards this position, the duty cycle is adjusted to a range between 10% and 40% and the spool 311 can be moved to a position by the VFS 307 and the spring 315, where spool land 311*e* is positioned to be slightly open to receiving fluid from the cushion pocket 352 via the cushion stop line 330 through port 342. The fluid from the cushion stop line 330 can exhaust to tank 326 via exhaust line 333 and port 344. The position of the spool land 311*e* relative to port 344 determines how much fluid and therefore cushion is present in the cushion pocket 352 and the speed in which the phaser can reach the full advance position. The position of the spool 311 can be controlled by the ECU 306 via the VFS 307.

Figure 12:
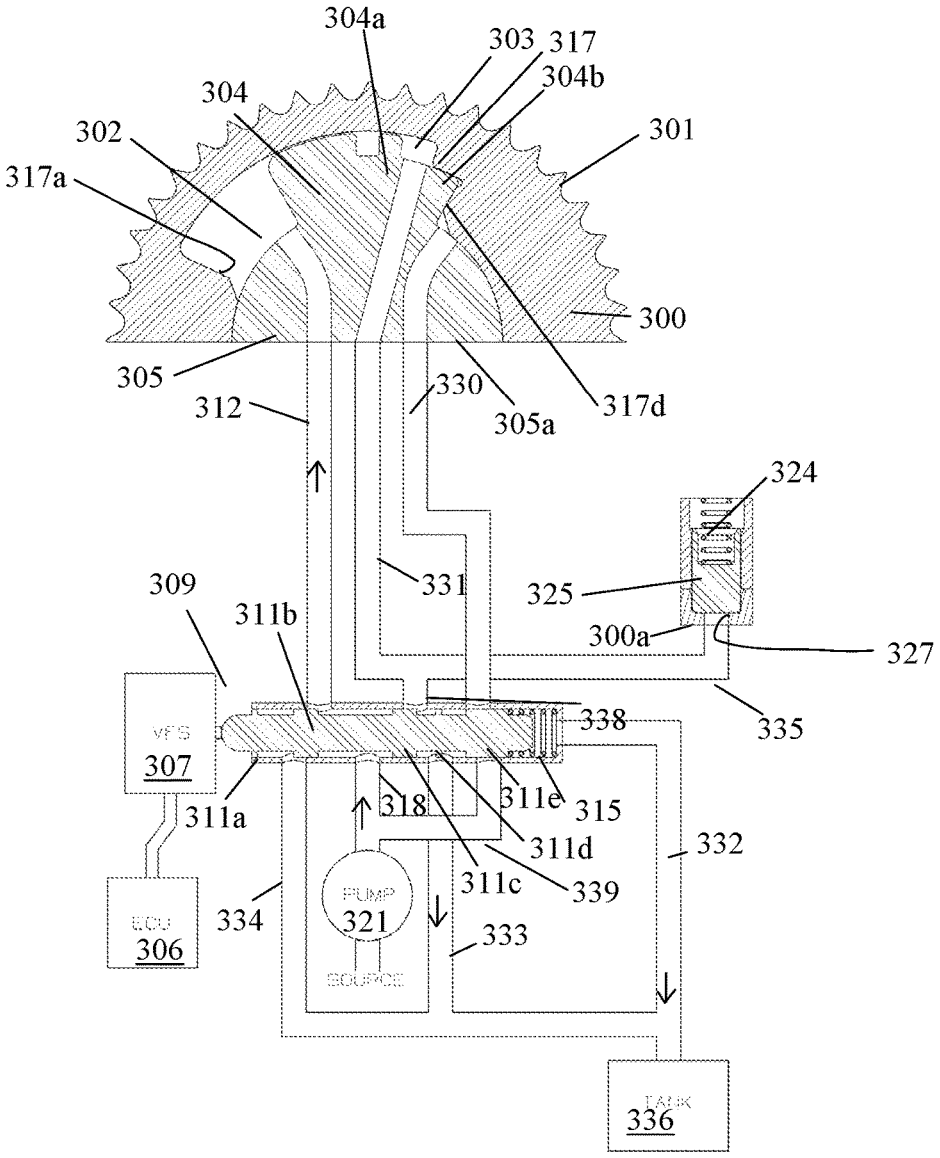
FIG. 12 shows a schematic of the phaser of the third embodiment with the phaser in the full advance position with the lock pin leaving the locked position.

FIG. 12 shows the phaser in a full advance position with the lock pin in a locked position. The full advance position is a position in which the protrusion 304*b* of the vane 304 is adjacent and directly contacts the recess 317*d* and the vane 304 contacts the retard wall 317*b* and a cushion pocket 352 is no longer present between the protrusion 304*b* and the recess 317*d* of the retard wall 317*b*. The fluid vacates the cushion pocket 352 through leakage at the interface 353 between the protrusion 304*b* and the housing assembly 300. Additionally, fluid may vacate the cushion pocket 352 through the spool 311 as shown in FIG. 11.

In the full advance position, the lock pin 325 can engage the recess 327 of the housing assembly 300, locking the movement of the rotor assembly 305 relative to the housing assembly 300. Fluid may be provided by pump 321 to the control valve 309 between spool lands 311*b* and 311*c* and to the advance chamber 302 via the advance line 312. Fluid from pump 321 is blocked from entering the retard chamber 303 from inlet line 318 by spool land 311*c*. Similarly, fluid from inlet line 318 is additionally blocked from entering line 335 leading to the lock pin 325 by spool land 311*c*.

Figure 13:
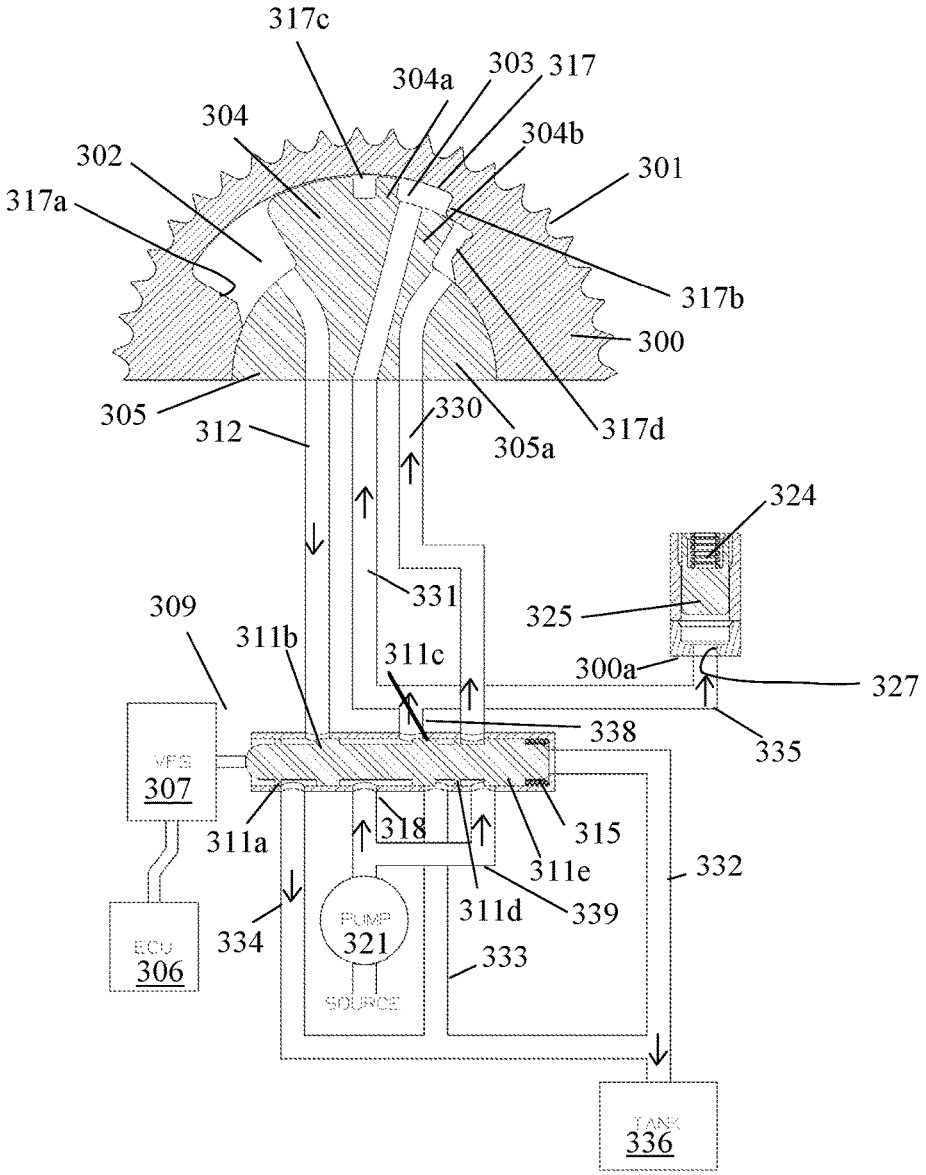
FIG. 13 shows a schematic of the phaser of the third embodiment with the phaser in the advance position with the lock pin leaving the locked position.

In order to leave the locked position at advance, the duty cycle is adjusted to a range greater than 60%, the force of the VFS 307 on the spool 311 is changed and the spool 311 is moved to the right in FIG. 13 by the VFS 307, until the force of spring 315 balances the force of the VFS 307. As shown in FIG. 13, in this position, fluid in the advance chamber 302 exits the advance chamber 302 through the advance line 312. From line 312, fluid flows through port 340 and between spool lands 311*a* and 311*b* to exhaust line 334 through port 346. From exhaust line 334, fluid flows to tank 336.

Fluid from pump 321 flows to an inlet line 318 and enters the control valve 309 through port 345 and between spool lands 311*b* and 311*c*. Fluid from inlet line 318 flows to line 338 from port 341. From line 338, fluid flows to line 335 and biases the lock pin 325 against the lock pin spring 324, such that the lock pin 325 is moved to an unlocked position. Fluid flows into the retard chamber 303 from retard line 331. Fluid additionally flows from inlet line 318, via line 339 through port 343 to the control valve 309. From port 343, fluid flows between spool lands 311*d* and 311*e*, through port 342 to cushion stop line 330. From the cushion stop line 330, fluid flows into the retard chamber 303. As fluid flows to the retard chamber 303, the vane 304 is biased away from the retard wall 317*b* and towards the advance wall 317*a*.

FIGS. 14-19 show a phaser of a fourth embodiment of the present invention.

The housing assembly 400 of the phaser has an outer circumference 401 for accepting drive force as well as a first end plate 400*a* and a second end plate (not shown). A bias spring 480 may be present on the second end plate 400*b* to bias the rotor assembly 405 towards an advance position. The rotor assembly 405 is connected to the camshaft and is coaxially located within the housing assembly 400. The rotor assembly 405 has a body 405*a* with at least one vane 404 extending therefrom. The at least one vane 404 separating a chamber 417 formed between the housing assembly 400 and the rotor assembly 405 into an advance chamber 402 and a retard chamber 403. The chamber 417 has an advance wall 417*a*, and a retard wall 417*b* separated by an arc 417*c* with an arc length. The vane 404 has a body 404*a* which extends a length from the body 405*a* of the rotor assembly 405 and slides relative to the arc 417*c* of the chamber 417. The body 404*a* of the vane 404 has a protrusion or step 404*b* extending laterally from the body 404*a*. The protrusion 404*b* of the body 404*a* of the vane 404 does not contact or slide relative to the arc 417*c* of the chamber 417. The vane 404 is capable of rotation to shift the relative angular position of the housing assembly 400 and the rotor assembly 405.

The rotor assembly 405 additionally contains an advance line 412 connecting the advance chamber 402 to a control valve 409, a cushion stop line 430 connecting the control valve 409 to the retard chamber 403, the cushion stop line 430 being in fluid communication with the retard chamber 103 and a retard line 431, line 435 in fluid communication with lock pin 425. The retard line 431 contains includes a one-way valve 460.

The lock pin 425 is slidably received within a bore (not shown) of the vane 404. The lock pin 425 is biased by a lock pin spring 424 to engage a recess 427 in the first end plate 400*a* of the housing assembly 400. The lock pin 425 is moveable between a locked position in which the lock pin 425 engages a first end plate 400*a* of the housing assembly 400 and an unlocked position in which the lock pin 425 does not engage the first end plate 400*a*.

The control valve 409, preferably a spool valve, includes a spool 411 with cylindrical lands 411*a*, 411*b*, 411*c*, 411*d* and 411*e*, slidably received in a sleeve 416 within a bore in the rotor assembly 405 and pilots in the camshaft (not shown). The control valve 409 may be located remotely from the phaser, within a bore in the rotor assembly 405 which pilots in the camshaft, or in a center bolt of the phaser. One end of the spool 411 contacts spring 415 and the opposite end of the spool 411 contacts a pulse width modulated variable force solenoid (VFS) 407. The solenoid 407 may also be linearly controlled by varying current or voltage or other methods as applicable. Additionally, the opposite end of the spool 411 may contact and be influenced by a motor, or other actuators.

The sleeve 416 of the control valve 409 has a series of ports 440-446. Port 440 is connected to advance line 412 in fluid communication with the advance chamber 402. Port 441 is connected to the cushion stop line 430 which is in fluid communication with the retard line 431. Both the cushion stop line 430 and the retard line 431 are in fluid communication with the retard chamber 403. Port 442 is connected to line 435 which is in fluid communication with lock pin 425. Port 443 is connected to inlet line 439. Port 444 is connected to exhaust line 433 and tank 436. Port 445 is connected to inlet line 418. Port 446 is connected to exhaust line 434 and tank 436.

The position of the control valve 409 is controlled by an engine control unit (ECU) 406 which controls the duty cycle of the variable force solenoid 407. The ECU 406 preferably includes a central processing unit (CPU) which runs various computational processes for controlling the engine, memory, and input and output ports used to exchange data with external devices and sensors. Further detail regarding control of the phaser is discussed in detail below. The position of the spool 411 controls the motion (e.g. move towards the phase to the retard position, advance position, and full advance position) of the phaser as well as whether the lock pin is locked or unlocked.

Based on the duty cycle of the pulse width modulated variable force solenoid 407, the spool 411 moves to a corresponding position along its stroke.

Figure 14:
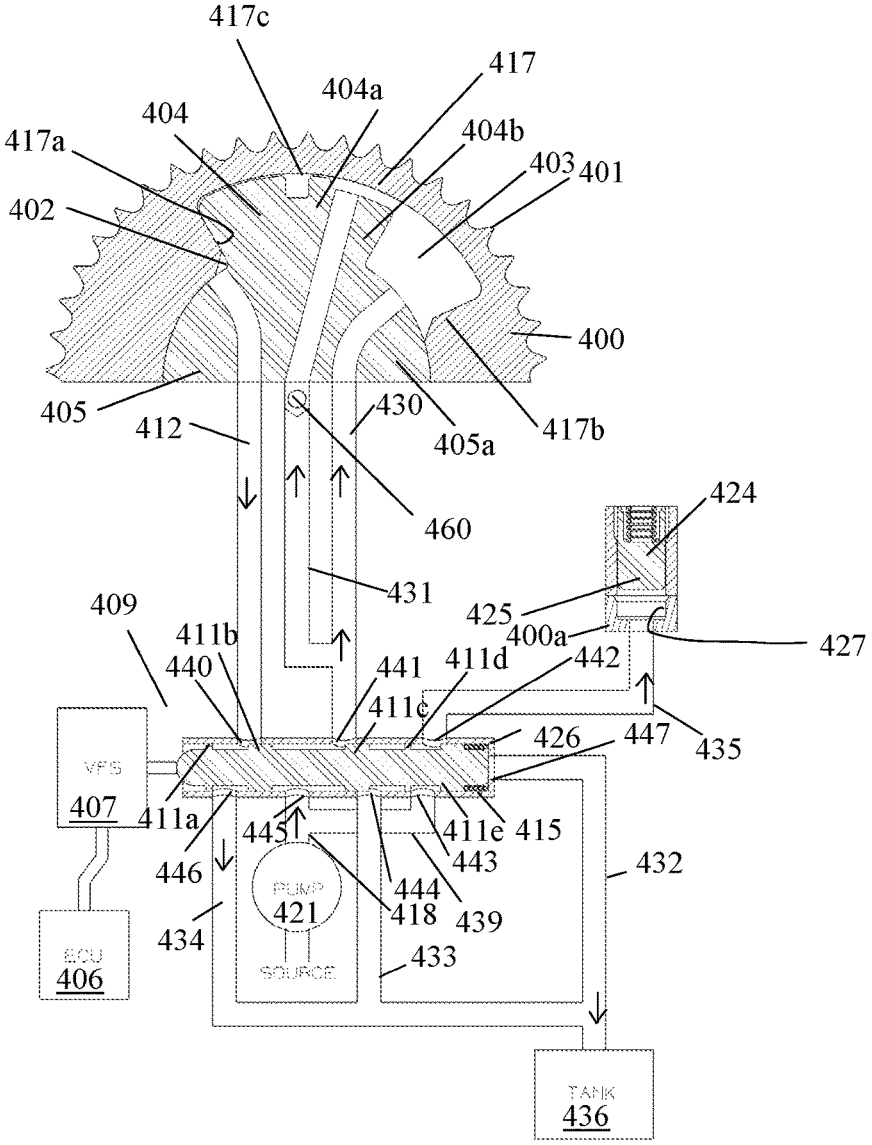
FIG. 14 shows a schematic of a phaser of a fourth embodiment with the phaser in the full retard position with the lock pin in an unlocked position.

FIG. 14 shows the phaser in a retard position. To move towards the retard position, the duty cycle is adjusted to a range of greater than 60%, the force of the VFS 407 on the spool 411 is changed and the spool 411 is moved to the right in a retard mode in the figure by the VFS 407, until the force of spring 415 balances the force of the VFS 407.

In this position, fluid in the advance chamber 402 exits the advance chamber 402 through the advance line 412. From advance line 412, fluid flows through port 440 and between spool lands 411*a* and 411*b* to exhaust line 434 through port 446. From exhaust line 434, fluid flows to tank 436.

Fluid from a pump 421 flows to an inlet line 418 and enters the control valve 409 through port 445 and between spool lands 411*b* and 411*c*. Fluid from the control valve 409 flows through port 441 to the cushion stop line 430. Fluid from the cushion stop line 430 flows to the retard chamber 403 and to the retard line 431. Fluid in the retard line 431 flows through the one-way valve 460 to the retard chamber 403.

Fluid from inlet line 418 flows to line 439 to the control valve 409 between spool lands 411*d* and 411*e* to port 442. From port 442, fluid flows to line 435 to bias the lock pin 425 against the lock pin spring 424, such that the lock pin 425 is moved to an unlocked position. In the retard position, both the retard line 431 and the cushion stop line 430 are exposed to the retard chamber 403.

Figure 15:
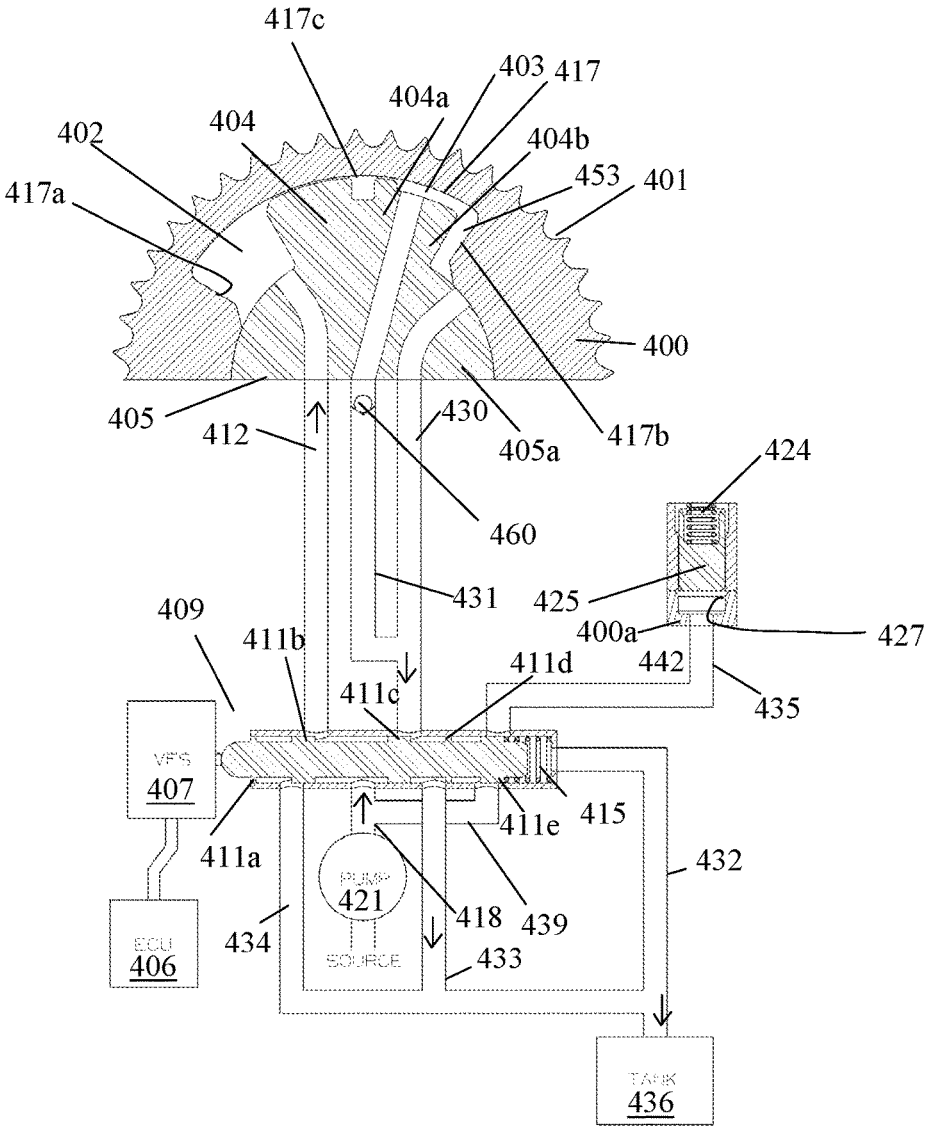
FIG. 15 shows a schematic of the phaser of the fourth embodiment with the phaser in an advanced position with the lock pin returning to a locked position and a cushioned stop present between the vane and the housing assembly.

FIG. 15 shows the phaser moving towards an advance position with the lock pin returning to a locked position. To move towards the advance position, the duty cycle is adjusted to a range of less than 40%, the force of the VFS 407 on the spool 411 is changed and the spool 411 is moved to the left in the figure by the spring 415, until the force of spring 415 balances the force of the VFS 407. In this position, fluid in the retard chamber 403 exits the retard chamber 403 through the cushion stop line 430 until the cushion stop line 430 is closed off by the housing assembly 400. Fluid in the cushion stop line 430 flows through port 441 and between spool lands 411*c* and 411*d* to line 4333 through port 444 and to tank 436.

As fluid enters the advance chamber 402 and exits the retard chamber 403, the vane 404 is shifted towards the retard wall 417*b*. The protrusion 404*b* of the vane 404, the housing assembly 400, the retard line 431, the one-way valve 460, the retard wall 417*b* forms a cushion pocket 452 in which fluid can accumulate or become trapped and cushions the impact of the vane 404 with the retard wall 417*b* and prevents the vane 404 from engaging the retard wall 417*b* and the phaser moving to a full retard position. The cushion pocket 452 is in fluid communication with the retard line 431. Fluid in the cushion pocket 452 is prevented from venting through the retard line 431 by one-way valve 460.

Fluid from pump 421 is prevented from flowing to line 435 by spool land 411*c*. Fluid in line 435 can flow through port 442 and out vent orifice 447 and to tank 436 via line 432. With the decrease in pressure in line 435, the lock pin spring 424 biases the lock pin 425 towards the recess 427. The lock pin 425 cannot be moved to a locked position until the vane 404 is rotated into a full retard position and the lock pin 425 in the vane 404 is aligned with recess 427 of the outer end plate 400*b* of the housing assembly 400. Fluid from pump 421 flows to an inlet line 418 and enters the control valve 409 through port 445 and between spool lands 411*b* and 411*c*. From the control valve 409, fluid flows through port 440 to advance line 412. From the advance line 412, fluid flows into the advance chamber 402. Fluid from inlet line 418 is blocked from entering the cushion stop line 430 by spool land 411*c*.

As fluid enters the advance chamber 402 and exits the retard chamber 403, the vane 404 is shifted towards the retard wall 417*b*.

In order to allow the lock pin 425 to engage the recess 427, and the rotor assembly 405 to rotate the vane 404 to a full retard position, the fluid present in the cushion pocket 452 between the retard wall 417*b*, the housing assembly 400 and the protrusion 404*b* of the vane 404 leaks out to the retard chamber 403 at the interface 453 between the housing assembly 400 and the cushion stop line 430. Fluid which leaks into the cushion stop line 430 flows through the control valve 409 to tank 436.

Figure 16:
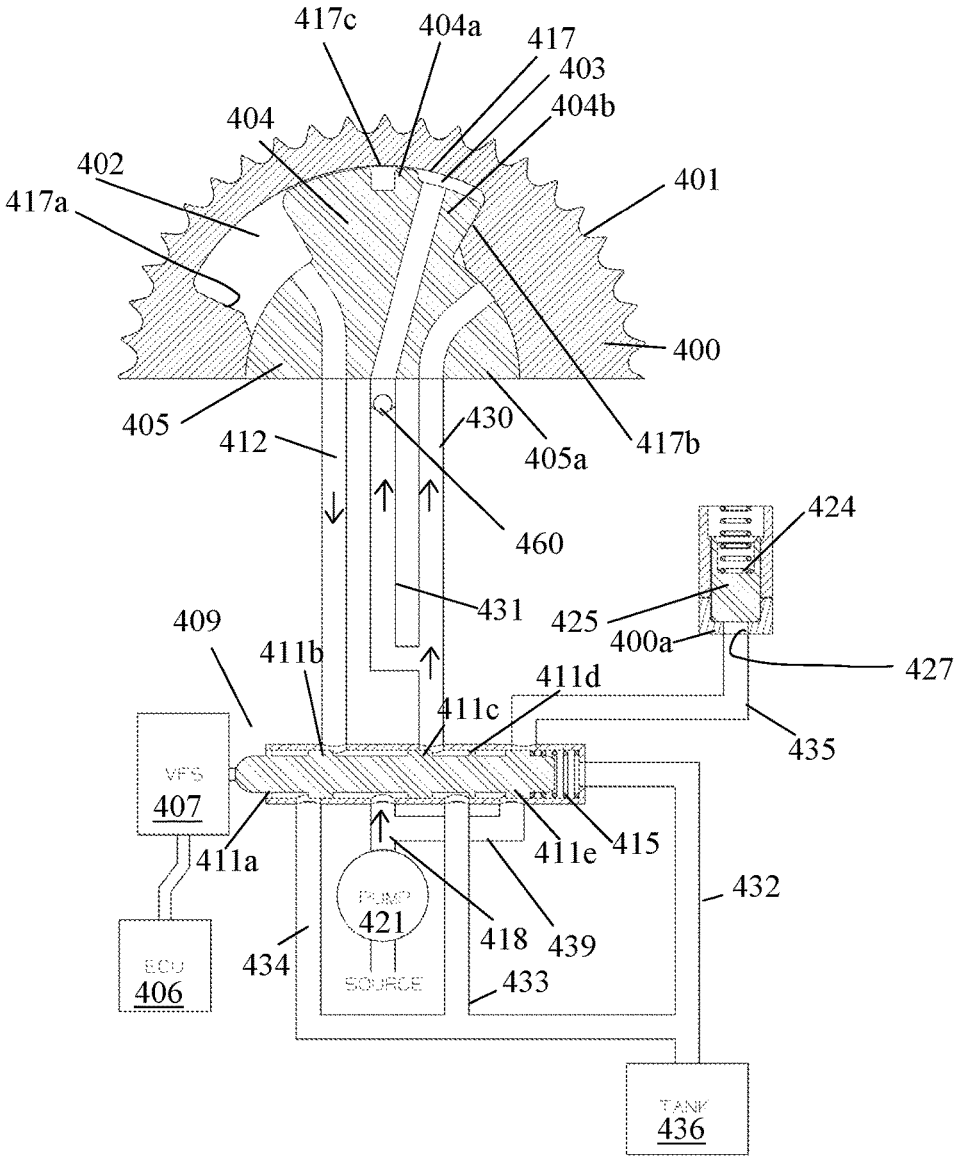
FIG. 16 shows a schematic of the phaser of the fourth embodiment with the phaser in the full advance position with the lock pin in the locked position.
Figure 17:
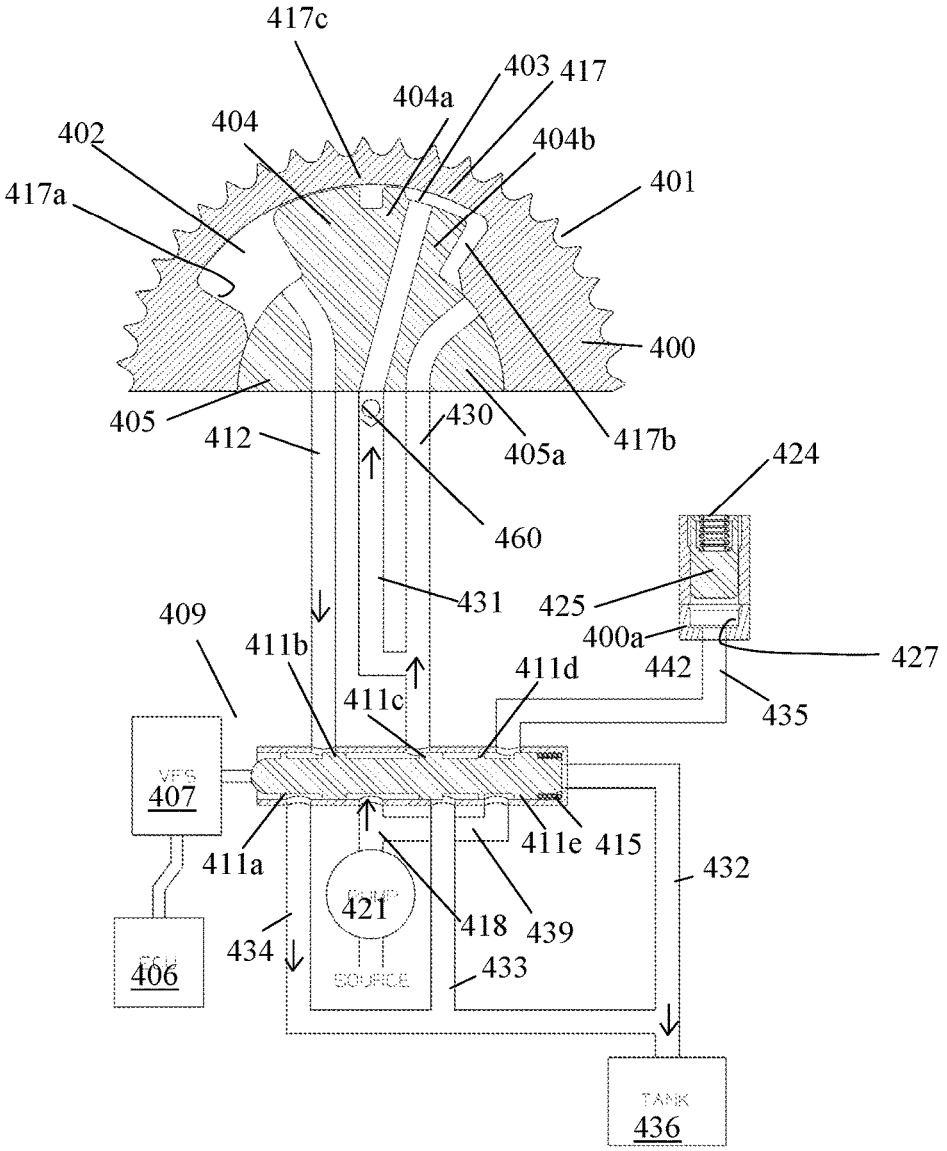
FIG. 17 shows a schematic of the phaser of the fourth embodiment with the phaser in the advance position with the lock pin leaving the locked position.

FIG. 16 shows the phaser in a full advance position with the lock pin in a locked position. The full advance position is a position in which the protrusion 404*b* of the vane 404 is adjacent and directly contacts the retard wall 417*b* and a cushion pocket is no longer present between the protrusion 404*b* and the retard wall 417*b*. The fluid vacates the cushion pocket 452 through leakage at the interface 453 between the rotor body 405*a* and the housing assembly 400.

In the full advance position, the lock pin 425 can engage the recess 427 of the housing assembly 400, locking the movement of the rotor assembly 405 relative to the housing assembly 400. Fluid may be provided by pump 421 to the control valve 409 between spool lands 411*b* and 411*c* and to the advance chamber 402 via the advance line 412. Fluid is blocked from entering the retard chamber 403 from inlet line 418 by spool land 411*c*. Similarly, fluid from inlet line 418 is additionally blocked from entering line 435 leading to the lock pin 425 by spool land 411*c*.

Figure 18:
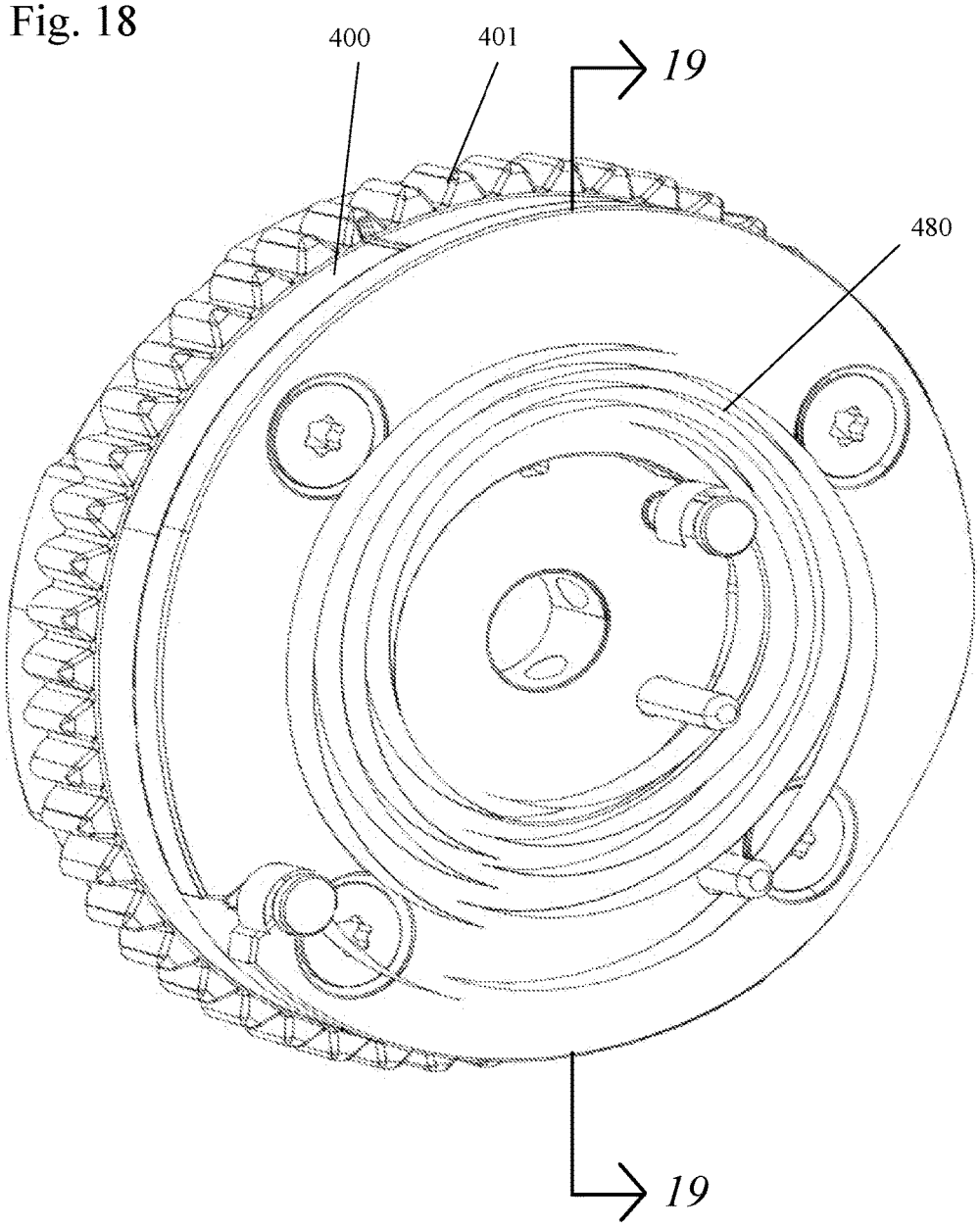
FIG. 18 shows a perspective view of the phaser of the fourth embodiment.
Figure 19:
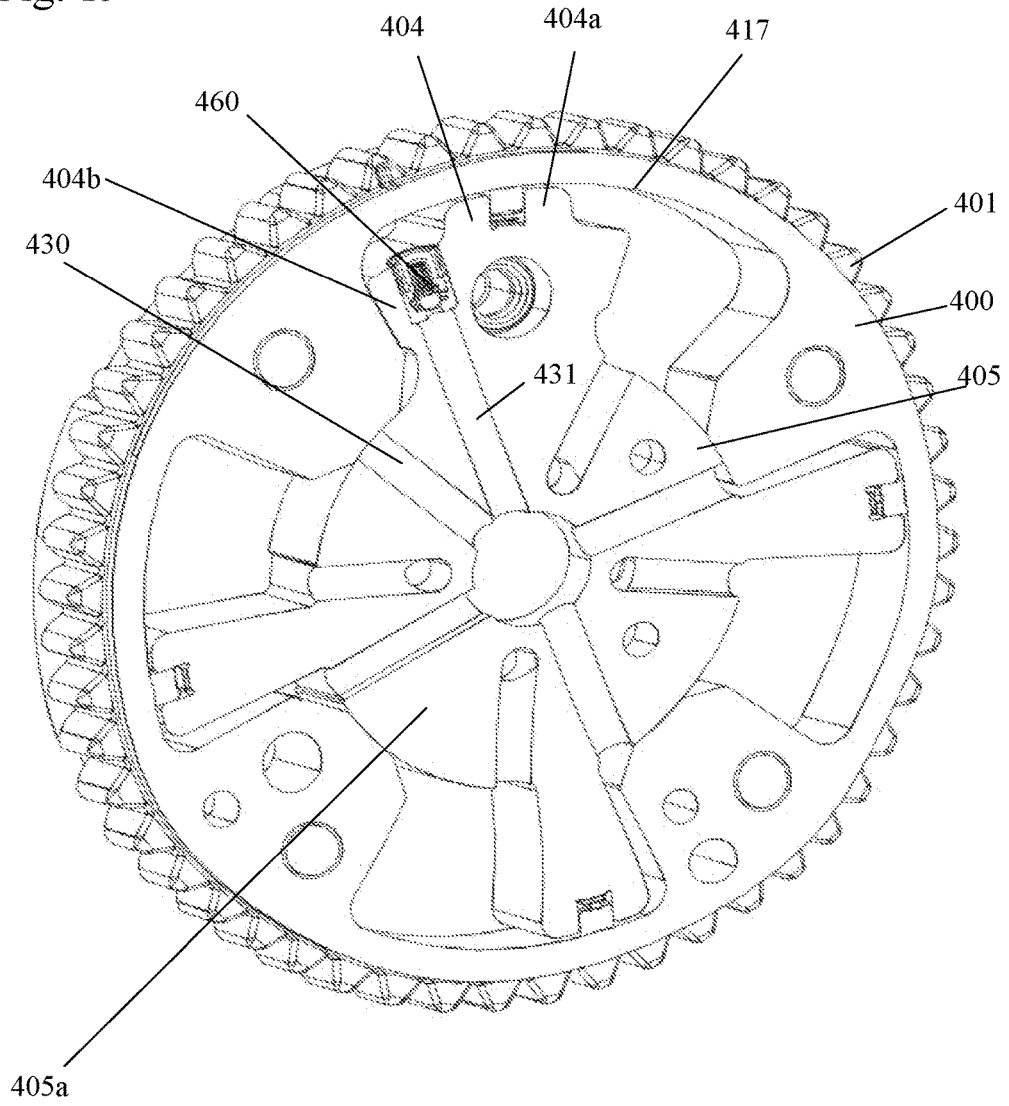
FIG. 19 shows a cross-sectional view of the phaser of the fourth embodiment along line 19-19 of FIG. 18.

In order to leave the locked position at advance, the duty cycle is adjusted to a range greater than 40% but less than 60%, the force of the VFS 407 on the spool 411 is changed and the spool 411 is moved to the right in FIG. 18 by the VFS 407, until the force of spring 415 balances the force of the VFS 407. As shown in FIG. 18, in this position, fluid in the advance chamber 402 exits the advance chamber 402 through the advance line 412. From advance line 412, fluid flows through port 440 and between spool lands 411*a* and 411*b* to exhaust line 434 through port 446. From exhaust line 434, fluid flows to tank 436.

Fluid from pump 421 flows to an inlet line 418 and enters the control valve 409 through port 445 and between spool lands 411*b* and 411*c*. Fluid from inlet line 418 flows to the cushion stop line 430 and the retard line 431 from port 441. Fluid from inlet line 418 also flows to line 439 and the control valve 409 via port 443. From the control valve 409, fluid flows through port 442 to line 435 and biases the lock pin 425 against the lock pin spring 424, such that the lock pin 425 is moved to an unlocked position. Fluid flows into the retard chamber 403 from retard line 431 and the through the one-way valve 460. As fluid flows to the retard chamber 403, the vane 404 is biased away from the retard wall 417*b* and towards the advance wall 417*a*, exposing the cushion stop line 430 to the retard chamber 403 and fluid can flow from inlet line 418 to the retard chamber 403 via the cushion stop line 430.

FIGS. 20-23 show a phaser of a fifth embodiment of the present invention.

The housing assembly 500 of the phaser has an outer circumference 501 for accepting drive force as well as a first end plate 500*a* and a second end plate (not shown). A bias spring may be present on the second end plate to bias the rotor assembly 405 towards an advance position. The rotor assembly 505 is connected to the camshaft and is coaxially located within the housing assembly 500. The rotor assembly 505 has a body 505*a* with at least two vanes 504, 552 extending therefrom. The first vane 504 separates a first chamber 517 formed between the housing assembly 500 and the rotor assembly 505 into a first advance chamber 502 and a first retard chamber 503. The first chamber 517 has a first advance wall 517*a*, and a first retard wall 517*b* separated by an arc 517*c* with an arc length. The first vane 504 has a body 504*a* with a protrusion or step 504*b*. The protrusion 504*b* of the body 504 does not slide relative to the arc 517*c* of the first chamber 517. The second vane 552 separates a second chamber 557 formed between the housing assembly 500 and the rotor assembly 505 into a second advance chamber 554 and a second retard chamber 555. The second chamber 557 has an advance wall 557*a* and a retard wall 557*b* separated by an arc 557*c* with an arc length. The second vane 552 has a body 552*a* which slides relative to the arc 557*c* of the second chamber 557. The vanes 504, 552 are capable of rotation to shift the relative angular position of the housing assembly 500 and the rotor assembly 505. The second advance chamber 554 is connected to the first advance chamber 502.

The rotor assembly 405 additionally contains: a first advance line 512 connecting the first advance chamber 502 to the second advance line 562; the second advance line 562, which is connected to the first advance line 512 via line 563, the second advance chamber 554 and the control valve 509; a second retard line 564 connected the second retard chamber 555 to the control valve 509; a cushion stop line 530 in fluid communication with the first retard chamber 503 and a retard line 531; line 535 in communication with the lock pin 525, the cushion stop line 530; lock pin 524; and the control valve 509. A lock pin 525 is in fluid communication with the control valve 509 via line 535. The first retard line 531 contains a one-way valve 560.

The lock pin 525 is slidably received within a bore (not shown) of the first vane 504. The lock pin 525 is biased by a lock pin spring 524 to engage a recess 527 in the first end plate 500*a* of the housing assembly 500. The lock pin 525 is moveable between a locked position in which the lock pin 525 engages a first end plate 500*a* of the housing assembly 500 and an unlocked position in which the lock pin 525 does not engage the first end plate 500*a*.

The control valve 509, preferably a spool valve, includes a spool 511 with cylindrical lands 511*a*, 511*b*, 511*c*, 511*d* and 511*e*, slidably received in a sleeve 516 within a bore in the rotor assembly 505 and pilots in the camshaft (not shown). The control valve 509 may be located remotely from the phaser, within a bore in the rotor assembly 505 which pilots in the camshaft, or in a center bolt of the phaser. One end of the spool 511 contacts spring 515 and the opposite end of the spool 511 contacts a pulse width modulated variable force solenoid (VFS) 507. The solenoid 507 may also be linearly controlled by varying current or voltage or other methods as applicable. Additionally, the opposite end of the spool 511 may contact and be influenced by a motor, or other actuators.

The sleeve 516 of the control valve 509 has a series of ports 540-546 and vent orifice 547. Port 540 is connected to the second advance line 562 in fluid communication with the second advance chamber 554, line 563, first advance line 512 and the first advance chamber 502. Port 541 is connected to the second retard line 564 and the second retard chamber 555. Port 542 is connected to line 535 in fluid communication with a lock pin 425 and the cushion stop line 530, which is also in fluid communication with the first retard line 531 and the first retard chamber 503. Both the cushion stop line 530 and the first retard line 531 are in fluid communication with the first retard chamber 503. Port 543 is connected to inlet line 539. Port 544 is connected to exhaust line 533 and tank 536. Port 545 is connected to inlet line 518. Port 546 is connected to exhaust line 534 and tank 536.

The position of the control valve 509 is controlled by an engine control unit (ECU) 506 which controls the duty cycle of the variable force solenoid 507. The ECU 506 preferably includes a central processing unit (CPU) which runs various computational processes for controlling the engine, memory, and input and output ports used to exchange data with external devices and sensors.

The position of the spool 511 is influenced by spring 515 and the solenoid 507 controlled by the ECU 506. Further detail regarding control of the phaser is discussed in detail below. The position of the spool 511 controls the motion (e.g. to move towards the advance position, full advance position, or the retard position) of the phaser as well as whether the lock pin is in the locked position or the unlocked position.

Based on the duty cycle of the pulse width modulated variable force solenoid 507, the spool 511 moves to a corresponding position along its stroke.

Figure 20:
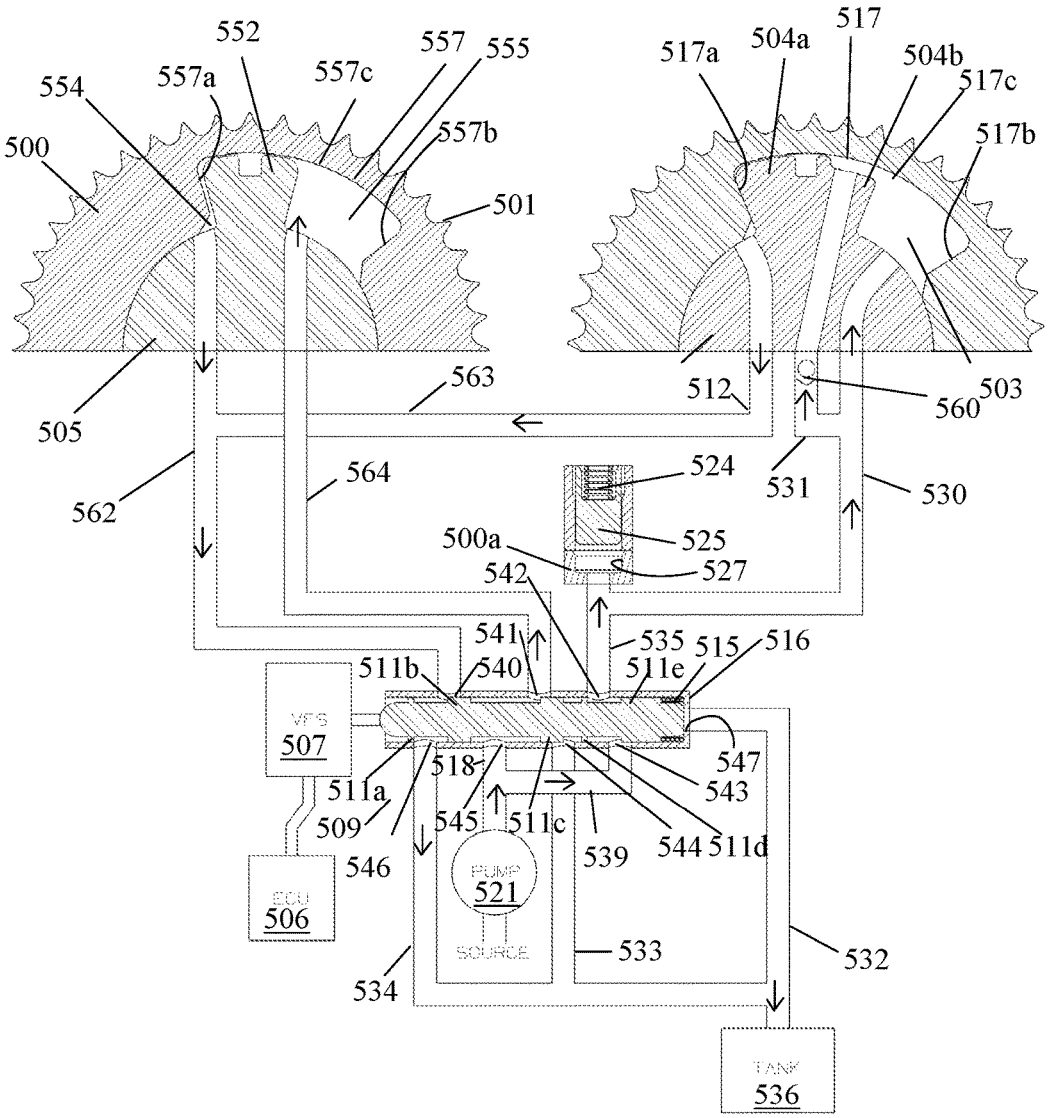
FIG. 20 shows a schematic of a phaser of a fifth embodiment with the phaser in the full retard position with the lock pin in an unlocked position.

FIG. 20 shows the phaser in a retard position. To move towards the retard position, the duty cycle is adjusted to a range of greater than 60%, the force of the VFS 507 on the spool 511 is changed and the spool 511 is moved to the right in a retard mode in the figure by the VFS 507, until the force of spring 515 balances the force of the VFS 507.

In this position, fluid in the first advance chamber 502 exits first advance chamber 502 through the first advance line 512 which flows through line 563 and to the second advance line 562. Fluid from the second advance chamber 554 exits the second advance chamber 554 through the second advance line 562. From the second advance line 562, fluid flows through port 540 and between spool lands 511*a* and 511*b* to exhaust line 534 through port 546. From exhaust line 534, fluid flows to tank 536.

Fluid from a pump 521 flows to an inlet line 518 and enters the control valve 509 through port 545 and between spool lands 511*b* and 511*c*. From the control valve 509, fluid flows through port 542 to the second retard line 564 and to the second retard chamber 555. Fluid from inlet line 418 flows through line 539 to the control valve 509 between spool lands 511*d* and 511*e*. From the control valve 509 fluid flows through port 543 to line 535 in fluid communication with the lock pin 525 and the cushion stop line 530. Fluid from the cushion stop line 530 flows to the first retard chamber 503 and to the first retard line 531. Fluid in the first retard line 531 flows through the one-way valve 560 to the first retard chamber 503. Fluid from line 535 biases the lock pin 525 against the lock pin spring 524, such that the lock pin 525 is moved to an unlocked position. In the retard position, both the first retard line 531 and the cushion stop line 530 are exposed to the first retard chamber 503.

Figure 21:
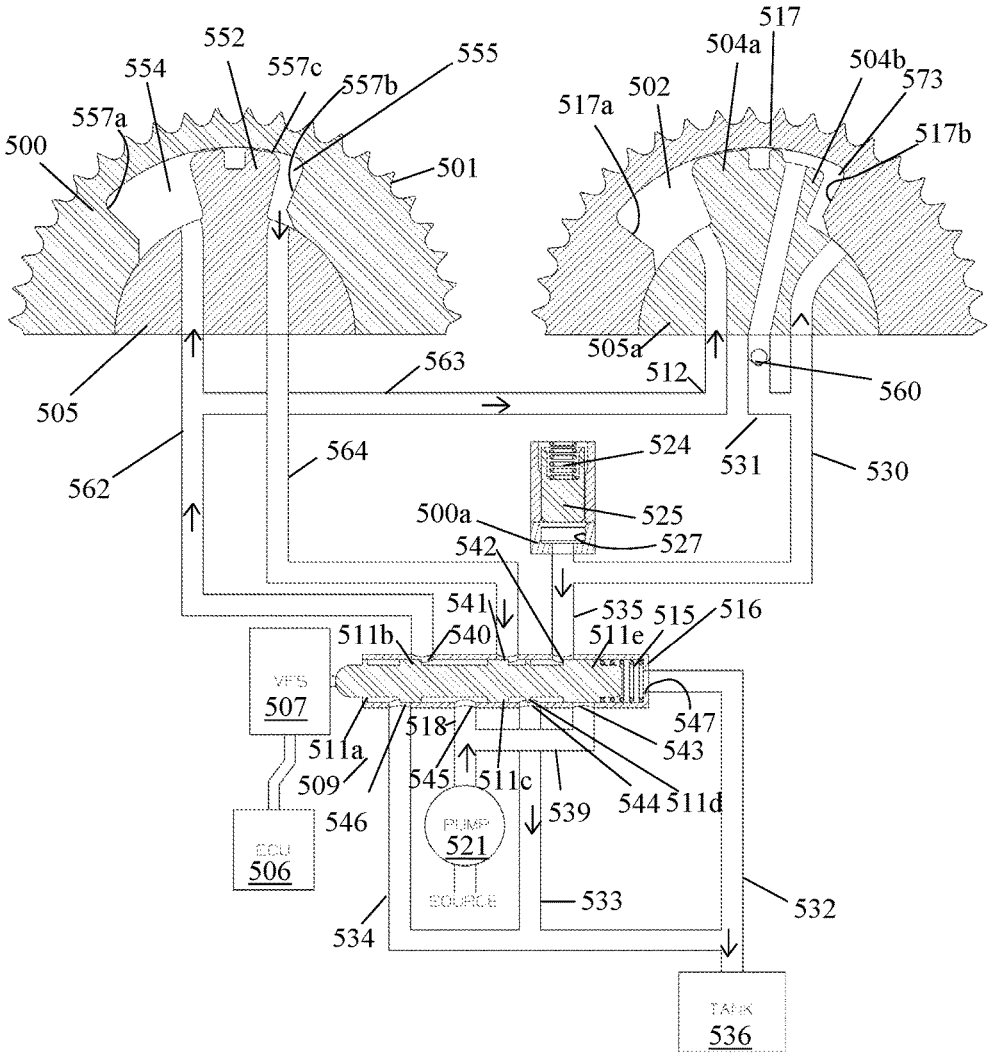
FIG. 21 shows a schematic of the phaser of the fifth embodiment with the phaser in an advanced position with the lock pin returning to a locked position and a cushioned stop present between the vane and the housing assembly.

FIG. 21 shows the phaser moving towards an advance position with the lock pin returning to a locked position. To move towards the advance position, the duty cycle is adjusted to a range of less than 40%, the force of the VFS 407 on the spool 511 is changed and the spool 511 is moved to the left in the figure by the spring 515, until the force of spring 515 balances the force of the VFS 507. In this position, fluid in the second retard chamber 555 exits the second retard chamber 555 through the second retard line 564 to port 541 of the control valve 509. From the control valve 509, fluid flows between spool lands 511*c* and 511*d* to port 544 and exhaust line 533 in connection with tank 536. Fluid from the first retard chamber 503 exits through the cushion stop line 530 until the cushion stop line 530 is closed off by the housing assembly 500. Fluid is prevented from exiting the first retard chamber 503 through the first retard line 531 by the one-way valve 560.

The protrusion 504*b* of the first vane 504, the arc 517*c* of the first chamber 517 of the housing assembly 500 and the first retard wall 517*b* forms a cushion pocket 572 in which fluid can accumulate or become trapped and cushions the impact of the first vane 504 with the first retard wall 517*b* and prevents the first vane 504 from engaging the first retard wall 517*b* and the phaser moving to a full retard position. It should be noted that since the first vane 504 and the second vane 552 are integrally formed with the rotor assembly 505, that while only one cushion pocket is present, the cushion pocket additionally prevents the second vane 552 from contacting the retard wall 557*b*. The cushion pocket 572 is in fluid communication with the first retard line 531. Fluid in the cushion pocket 572 will flow through the cushion stop line 530, but be prevented from leaving the cushion pocket 572 by the one-way valve 560. Fluid in the cushion stop line 530 flows to port 542 and between spool lands 511*d* and 511*e* of the control valve 509 to exhaust line 533 through port 544 and to tank 536.

Fluid from a pump 521 flows to an inlet line 518 and enters the control valve 509 through port 545 and between spool lands 511*b* and 511*c*. Fluid from source flows to second advance line 562 from port 540. From the second advance line 562, fluid flows into the first second advance chamber 554 and the first advance chamber 502 via line 563 and the first advance line 512. Fluid from inlet line 418 is blocked from entering the cushion stop line 530 by spool land 511*c*. Fluid is additionally prevented from flowing to line 535 and the lock pin 525 by spool land 511*e*, allowing the lock pin spring 524 to bias the lock pin 525 towards the recess 527 of the housing assembly 500. The lock pin 525 cannot be moved to a locked position until the first vane 504 is rotated into a full retard position and the lock pin 525 in the vane 504 is aligned with recess 527 of the first outer end plate 500*a* of the housing assembly 500.

As fluid enters the first advance chamber 502 and the second advance chamber 554 and exits the first retard chamber 503 and the second retard chamber 555, the first and second vanes 504, 552 are shifted towards the retard walls 517*b*, 557*b*.

In order to allow the lock pin 525 to engage the recess 527, and the rotor assembly 505 to rotate the first vane 504 to a full retard position, the fluid present in the cushion pocket 572 between the first retard wall 517*b*, the housing assembly 500 and the protrusion 504*b* of the vane 504 between leaks out to the first retard chamber 503 at the interface 573 between the housing assembly 500 and the cushion stop line 530. Fluid which leaks into the cushion stop line 530 flows through the control valve 509 to tank 536.

Figure 22:
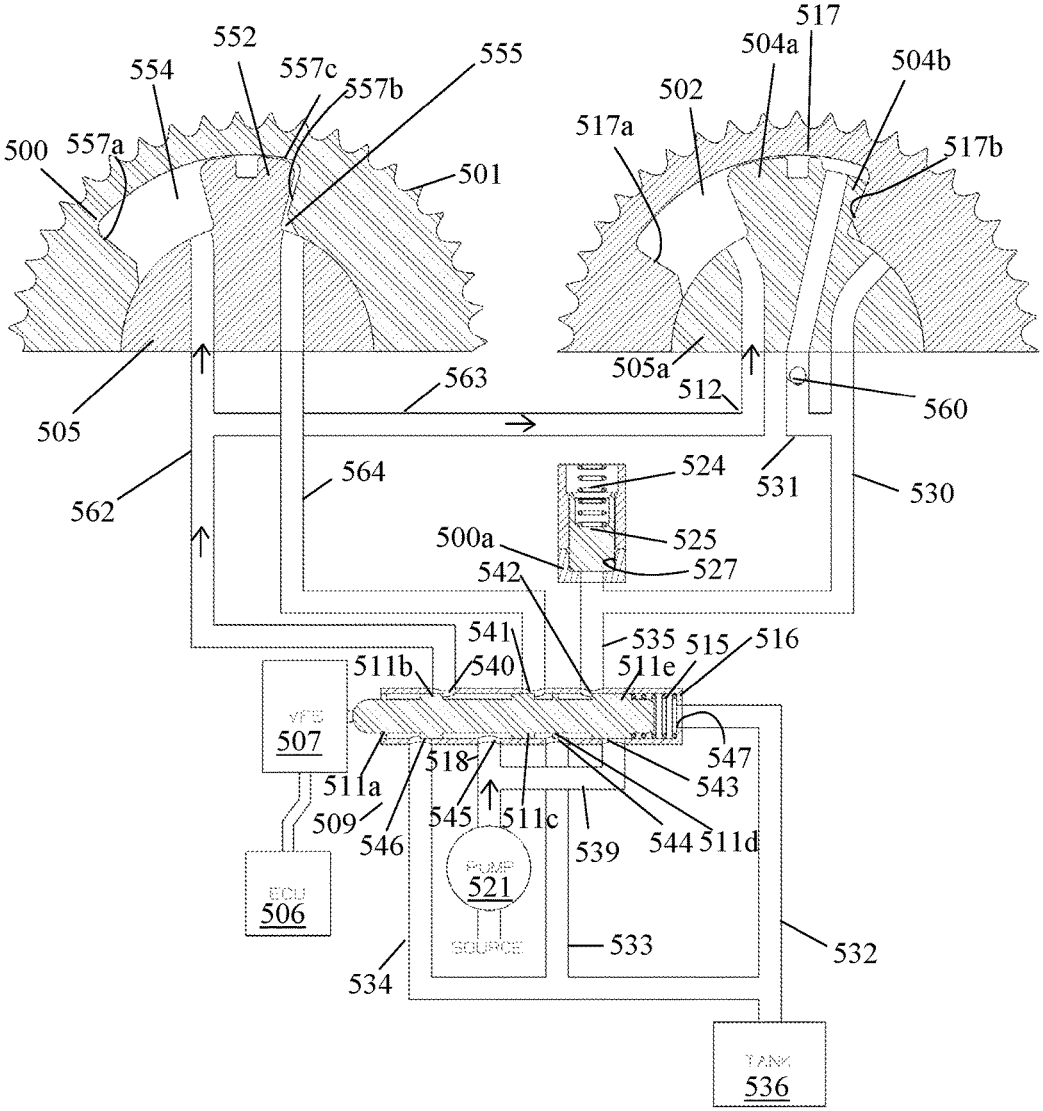
FIG. 22 shows a schematic of the phaser of the fifth embodiment with the phaser in the full advanced position with the lock pin in the locked position.

FIG. 22 shows the phaser in a full advance position with the lock pin in a locked position. The full advance position is a position in which the protrusion 504*b* of the first vane 504 is adjacent and directly contacts the first retard wall 517*b* and a cushion pocket is no longer present between the protrusion 504*b* and the first retard wall 517*b*. The fluid vacates the cushion pocket 572 through leakage at the interface 573 between the protrusion 504*b* and the housing assembly 500 as discussed above.

In the full advance position, the lock pin 525 can engage the recess 527 of the housing assembly 500, locking the movement of the rotor assembly 505 relative to the housing assembly 500. Fluid may be provided by pump 521 to the control valve 509 between spool lands 511*b* and 511*c* and to the first advance chamber 402 and the second advance chamber 554 via the second advance line 562, line 563 and first advance line 512. Fluid is blocked from entering the second retard chamber 555 from inlet line 518 by spool land 511*c*. Similarly, fluid from inlet line 518 is additionally blocked from entering line 535, cushion stop line 530, and first retard line 531 by spool land 511*c*.

Figure 23:
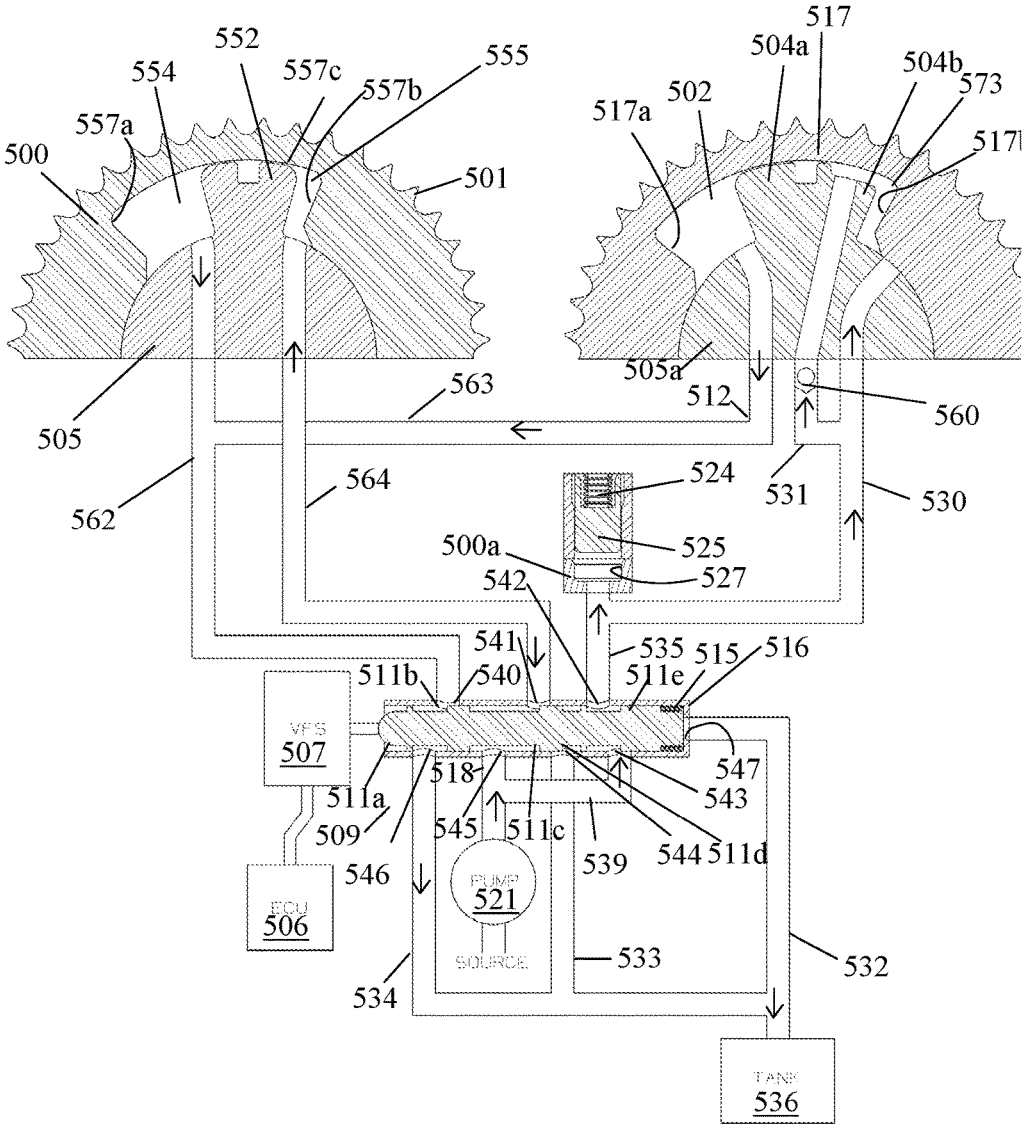
FIG. 23 shows a schematic of the phaser of the fifth embodiment with the phaser in the advanced position with the lock pin leaving the locked position.

In order to leave the locked position at advance, the duty cycle is adjusted to a range greater than 40% but less than 60%, the force of the VFS 507 on the spool 511 is changed and the spool 511 is moved to the right in FIG. 23 by the VFS 507, until the force of spring 515 balances the force of the VFS 507. As shown in FIG. 23, in this position, fluid in the first advance chamber 502 exits the first advance chamber 502 through the first advance line 512. From the first advance line 512, fluid flows to line 563 and to the second advance line 562. Fluid from the second advance chamber 554 also exits to the control valve 509 through the second advance line 562. From the second advance line 562, fluid enters the control valve 509 through port 540 and between spool lands 511*a* and 511*b* to exhaust line 534 through port 546. From exhaust line 534, fluid flows to tank 536.

Fluid from pump 521 flows to an inlet line 518 and enters the control valve 509 through port 545 and between spool lands 511*b* and 511*c*. From the control valve 509, fluid flows through port 541 and to the second retard line 564 to the second retard chamber 555.

Fluid from inlet line 518 also flows to line 539 and the control valve 509 via port 543. From the control valve 509, fluid flows through port 542 to line 535 and biases the lock pin 525 against the lock pin spring 524, such that the lock pin 525 is moved to an unlocked position. Fluid from line 535 also flows to cushion stop line 530. From cushion stop line 530, fluid flows to the first retard chamber 503, and the first retard line 531. Fluid in the first retard line 531 flows through the one-way valve 560 to the first retard chamber 503. As fluid flows to the first retard chamber 503, the first vane 504 is biased away from the first retard wall 517*b* and towards the first advance wall 517*a*, exposing the cushion stop line 530 to the first retard chamber 503 and fluid can flow from inlet line 518 to the first retard chamber 503 via the cushion stop line 530.

The figures of the previous embodiments show a cushion pocket present only when the phaser is moving towards the advance direction, however, the cushion pocket may be present when the phaser is moving towards the retard direction or in moving towards both the advance direction and the retard direction as shown in FIGS. 24-27.

Referring to FIGS. 24-27, the housing assembly 600 of the phaser has an outer circumference 601 for accepting drive force as well as a first end plate 600*a* and a second end plate (not shown). A bias spring may be present on the second end plate (not shown) to bias the rotor assembly 605 towards an advance position. The rotor assembly 605 is connected to the camshaft (not shown) and is coaxially located within the housing assembly 600. The rotor assembly 605 has a body 605*a* with at least one vane 504 extending therefrom. The at least one vane 604 separating a chamber 617 formed between the housing assembly 600 and the rotor assembly 605 into an advance chamber 602 and a retard chamber 603. The chamber 617 has an advance wall 617*a*, and a retard wall 617*b* separated by an arc 617*c* with an arc length. The vane 604 has a body 604*a* which extends a length from the rotor assembly 405 and slides relative to the arc 617*c* of the chamber 617. The body 604*a* of the vane 604 has a first protrusion or step 604*b* extending laterally from a first side of the body 604*a* and a second protrusion or step 604*c* extending laterally from a second side of the body 604*a*. The first protrusion 604*b* and the second protrusion 604*c* of the body 604*a* of the vane 604 do not contact or slide relative to the arc 617*c* of the chamber 617. The retard wall 617*b* has a recess 617*d* which can receive the first protrusion 604*b* of the vane 604, such that the body 604*a* of the vane 104 is adjacent and directly contacts the retard wall 617*b*. The advance wall 617*a* has a recess 617*e* which can receive the second protrusion 604*c* of the vane 604 such that the body 604*a* of the vane is adjacent and directly contacts the advance wall 617*a*. The vane 604 is capable of rotation to shift the relative angular position of the housing assembly 600 and the rotor assembly 605.

The rotor assembly 605 additionally contains an advance cushion stop line 629 connecting the advance chamber 602 to a control valve 609 and in connection to an advance line 612, a retard line 631 connecting the retard chamber 603 to the control valve 609, a retard cushion stop line 630 in fluid communication with the retard chamber 603 and the retard line 631 and exhaust line 635 in communication with the retard line 631 and the lock pin 625. The retard cushion stop line 630 includes a retard one-way valve 660 and the advance cushion stop line 629 includes a one-way valve 661.

The lock pin 625 is slidably received within a bore of the vane 604. The lock pin 625 is biased by a lock pin spring 624 to engage a recess 627 in the end plate 600*b* of the housing assembly 600. The lock pin 625 is moveable between a locked position in which the lock pin 625 engages a first end plate 600*a* of the housing assembly 600 and an unlocked position.

The control valve 609, preferably a spool valve, includes a spool 611 with cylindrical lands 611*a*, 611*b*, 611*c*, and 611*d* slidably received in a sleeve 616 within a bore in the rotor assembly 605 and pilots in the camshaft (not shown). The control valve 609 may be located remotely from the phaser, within a bore in the rotor assembly 605 which pilots in the camshaft, or in a center bolt of the phaser. One end of the spool 611 contacts spring 615 and the opposite end of the spool 611 contacts a pulse width modulated variable force solenoid (VFS) 607. The solenoid 607 may also be linearly controlled by varying current or voltage or other methods as applicable. Additionally, the opposite end of the spool 611 may contact and be influenced by a motor, or other actuators.

The sleeve 616 of the control valve 609 has a series of ports 640-644. Port 640 is connected to the advance cushion stop line 629 in fluid communication with the advance chamber 602 and the advance line 612. Port 641 is connected to exhaust line 635 in fluid communication with lock pin 625 and the retard line 631 in fluid communication with the retard chamber 603 and the retard cushion stop line 630. Port 642 is in fluid communication with an exhaust line 633 and tank 636. Port 643 is in fluid communication with an inlet line 618. Port 644 is in fluid communication with an exhaust line 634 and tank 636.

The position of the control valve 609 is controlled by an engine control unit (ECU) 606 which controls the duty cycle of the variable force solenoid 607. The ECU 606 preferably includes a central processing unit (CPU) which runs various computational processes for controlling the engine, memory, and input and output ports used to exchange data with external devices and sensors.

The position of the spool 611 is influenced by spring 615 and the solenoid 607 controlled by the ECU 106. Further detail regarding control of the phaser is discussed in detail below. The position of the spool 611 controls the motion (e.g. to move towards the advance position, retard position or full advance position) of the phaser as well as whether the lock pin is moved to locked position or an unlocked position.

Based on the duty cycle of the pulse width modulated variable force solenoid 607, the spool 611 moves to a corresponding position along its stroke.

Figure 24:
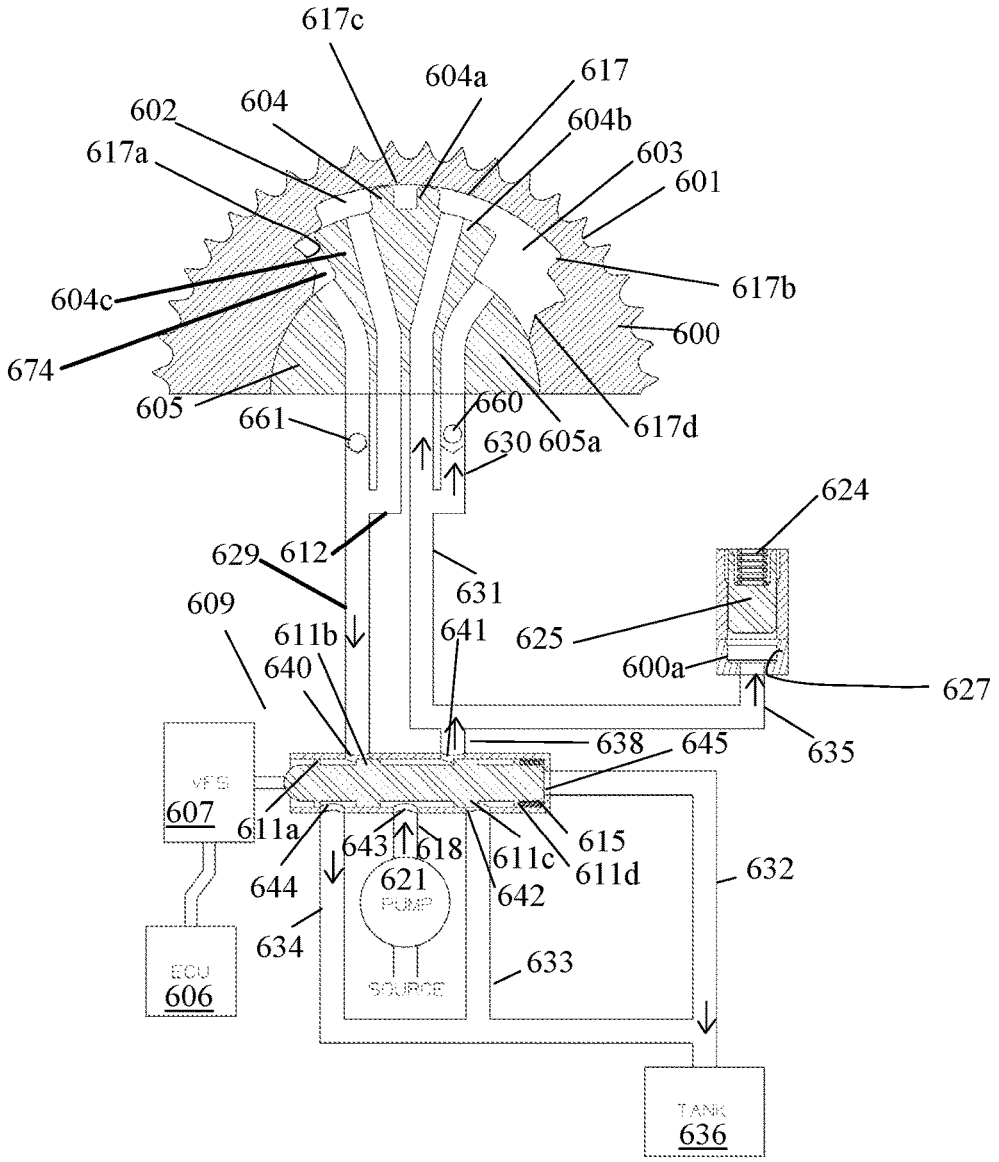
FIG. 24 shows a schematic of a phaser of a sixth embodiment with the phaser in the retard position, an advanced cushion formed between the vane and the housing assembly and with the lock pin in an unlocked position.

FIG. 24 shows the phaser in a retard position. To move towards the retard position, the duty cycle is adjusted to a range greater than 60%, the force of the VFS 607 on the spool 611 is changed and the spool 611 is moved to the right in a retard mode in the figure by the VFS 607, until the force of spring 615 balances the force of the VFS 607. In this position, fluid in the advance chamber 602 exits the advance chamber 602 through the advance line 612. From the advance line 612, fluid flows through the advance cushion stop line 629 through port 640 and between spool lands 611*a* and 611*b* to exhaust line 634 through port 644. From exhaust line 634, fluid flows to tank 636.

Fluid from pump 621 flows to an inlet line 618 and enters the control valve 609 through port 643 and between spool lands 611*b* and 611*c*. From the control valve 609, fluid flows through port 641 to exhaust line 635 and the retard line 631. Fluid from exhaust line 635 biases the lock pin 625 against the lock pin spring 624, such that the lock pin 625 is moved to an unlocked position. Fluid flows into the retard chamber 603 from retard line 631. Additionally, fluid from retard line 631 flows into theretard cushion stop line 630 and through retard one-way valve 660. In the retard position, both the retard line 631 and theretard cushion stop line 630 are exposed to the retard chamber 603.

As fluid enters the retard chamber 603 and exits the advance chamber 602, the vane 604 is shifted towards the advance wall 617*a*. The second protrusion 604*c* of the vane 604, the housing assembly 600, and the recess 617*e* of the advance wall 617*a* forms an advance cushion pocket 674 in which fluid can accumulate or become trapped and cushions the impact of the vane 604 with the advance wall 617*a* and prevents the vane 604 from engaging the recess 617*e* of the advance wall 617*a* and the phaser moving to a full retard position. The advance cushion pocket 674 is in fluid communication with the advance cushion stop line 629. Fluid in the advance cushion pocket 674 will flow through the advance cushion stop line 629, but be prevented from leaving the advance cushion pocket 674 by one-way valve 661.

Figure 25:
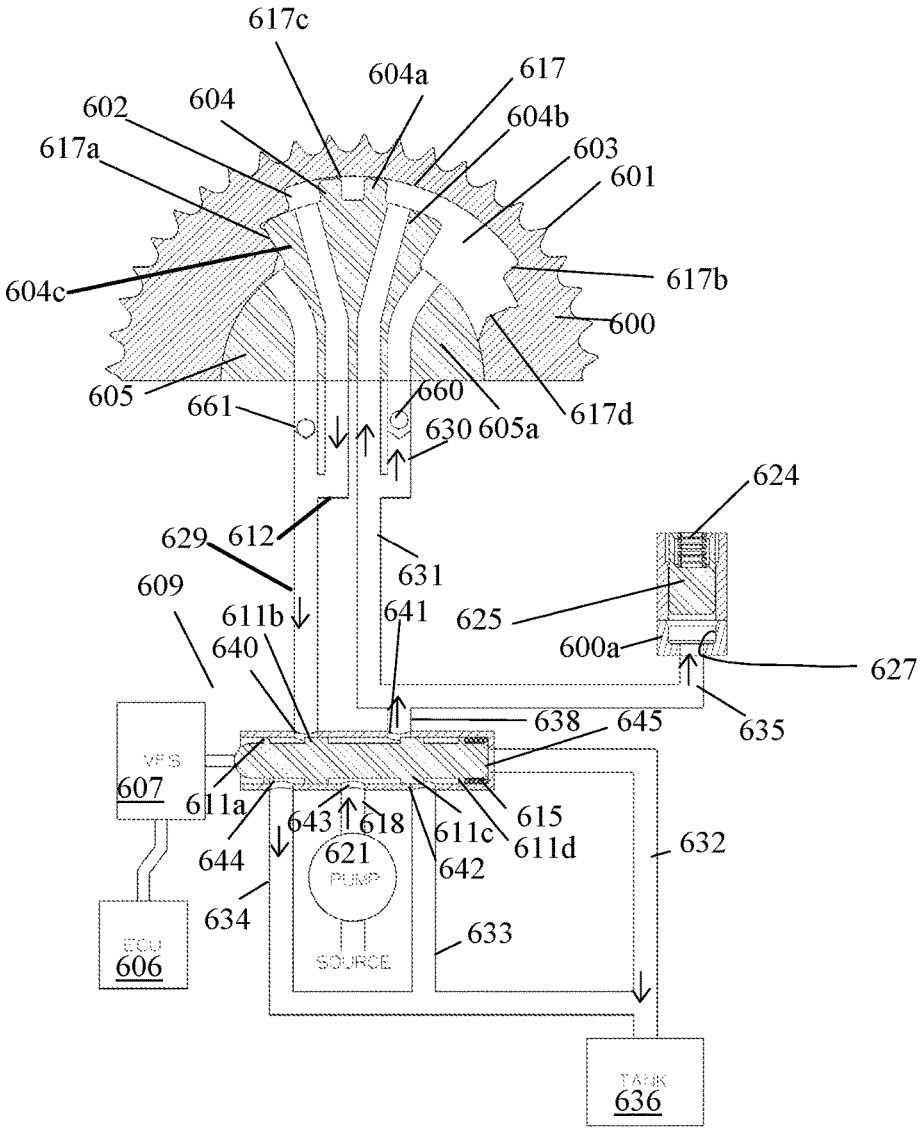
FIG. 25 shows a schematic of the phaser of the sixth embodiment with the phaser in the full retard position and the lock pin in an unlocked position.

FIG. 25 shows the phaser in a full retard position with the lock pin 625 in the unlocked position. To move towards the retard position, the duty cycle is adjusted to a range greater than 60%, the force of the VFS 607 on the spool 611 is changed and the spool 611 is moved to the right in a retard mode in the figure by the VFS 607. The full retard position is a position in which the second protrusion 604*c* of the vane 604 is adjacent and directly contacts the advance wall 617*a* and the advance cushion pocket 674 is no longer present between the second protrusion 604*c* and the advance wall 617*a*. The fluid vacates the advance cushion pocket 674 through leakage at the interface 675 between the second protrusion 604*c* and the housing assembly 600. The fluid that leaks flows through the advance line 612 to the advance cushion stop line 629 and to tank via the control valve 609. Fluid may be provided by inlet line 618 to the control valve 609 between spool lands 611*b* and 611*c* and to the retard chamber 603 via the retard line 631. Fluid is additionally provided to exhaust line 635 and the lock pin 625, biasing the lock pin 625 against the lock pin spring 624 to an unlocked position. Fluid is blocked from entering the advance chamber 602 from supply by spool land 611*b*.

Figure 26:
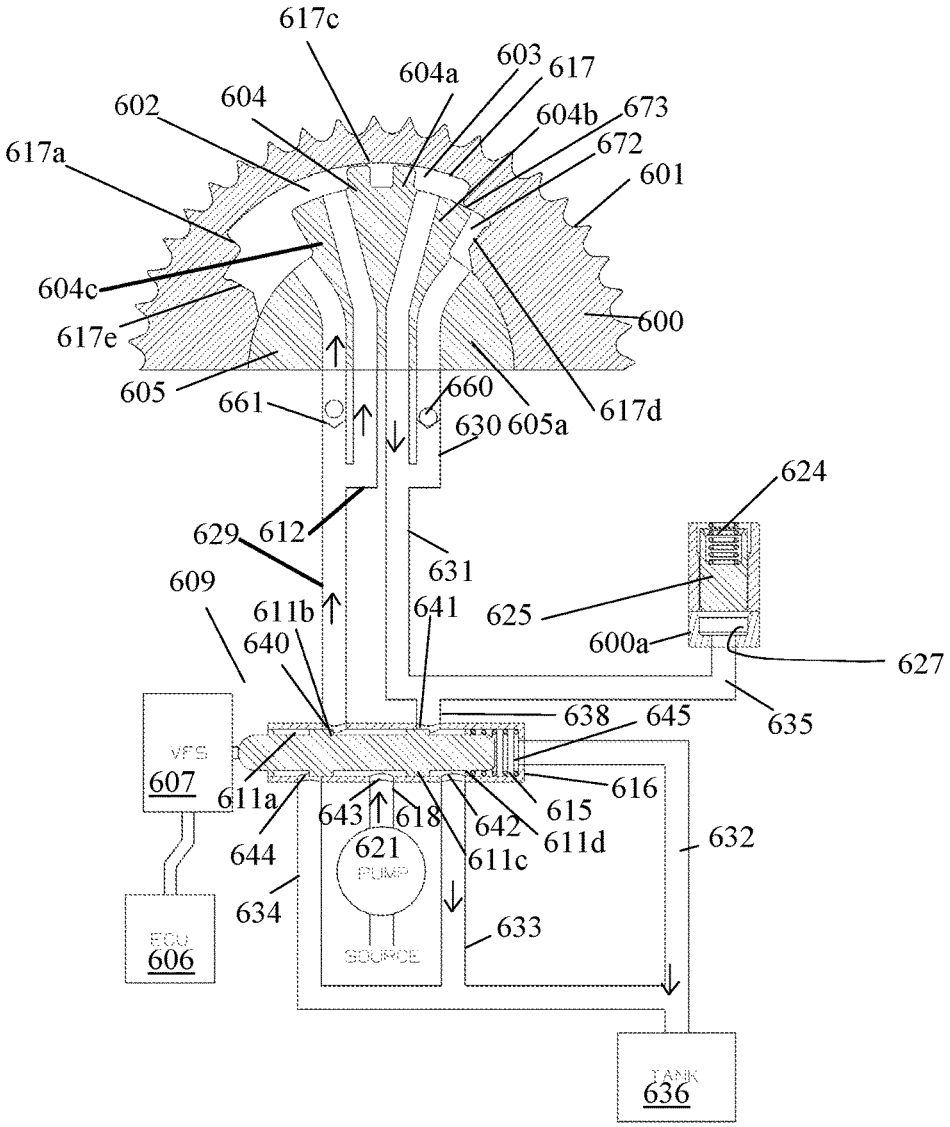
FIG. 26 shows a schematic of the phaser of the sixth embodiment with the phaser in an advance position with the lock pin returning to the locked position and a retard cushioned stop present between the housing assembly and the vane

FIG. 26 shows the phaser moving towards an advance position with the lock pin returning to a locked position. To move towards the advance position, the duty cycle is adjusted to a range less than 40%, the force of the VFS 607 on the spool 611 is changed and the spool 611 is moved to the left in the figure by the spring 615, until the force of spring 615 balances the force of the VFS 607. In this position, fluid in the retard chamber 603 exits the retard chamber 603 through the retard line 631. From retard line 631, fluid flows through port 641 and between spool lands 611*c* and 611*d* to exhaust line 633 through port 642 and to tank 636.

Fluid from a pump 621 flows to inlet line 618 and enters the control valve through port 643 and between spool lands 611*b* and 611*c*. Fluid from inlet line 618 flows to advance cushion stop line 629. From the advance cushion stop line 629, fluid flows through the one-way valve 661 to the advance chamber 602. Fluid from the advance cushion stop line 629 also flows through the advance line 612 to the advance chamber 602.

As fluid enters the advance chamber 602 and exits the retard chamber 603, the vane 604 is shifted towards the retard wall 617*b*. The first protrusion 604*b* of the vane 604, the housing assembly 600, and the recess 617*d* of the retard wall 617*b* forms a retard cushion pocket 672 in which fluid can accumulate or become trapped and cushions the impact of the vane 604 with the retard wall 617*b* and prevents the vane 604 from engaging the retard wall 617*b* and the phaser moving to a full advance position. The retard cushion pocket 672 is in fluid communication with the retard cushion stop line 630. Fluid in the retard cushion pocket 672 will flow through the retard cushion stop line 630, but be prevented from leaving the retard cushion pocket 672 by the retard one way valve 660. Fluid from inlet line 618 is prevented from flowing to exhaust line 635 by spool land 611*c*. Fluid in exhaust line 635 can flow through port 641 and between spool lands 611*c* and 611*d* to exhaust line 633 and tank 636. As the pressure of fluid in exhaust line 635 decreases, the lock pin spring 624 will bias the lock pin 625 towards the recess 627. The lock pin 625 cannot be moved to a locked position until the vane 604 is rotated into a full retard position and the lock pin 625 in the vane 604 is aligned with recess 627 of the first end plate 600*a* of the housing assembly 600.

In order to allow the lock pin 625 to engage the recess 627, and the rotor assembly 605 to rotate the vane 604 to a full retard position, the fluid present in the retard cushion pocket 672 between the retard wall 617*b*, the housing assembly 600, and the first protrusion 604*b* of the vane 604 leaks out to the retard chamber 603 at the interface 673 between the first protrusion 604*b* and the housing assembly 600. Fluid which leaks to the retard chamber 603 flows through the control valve 609 to tank 636.

Figure 27:
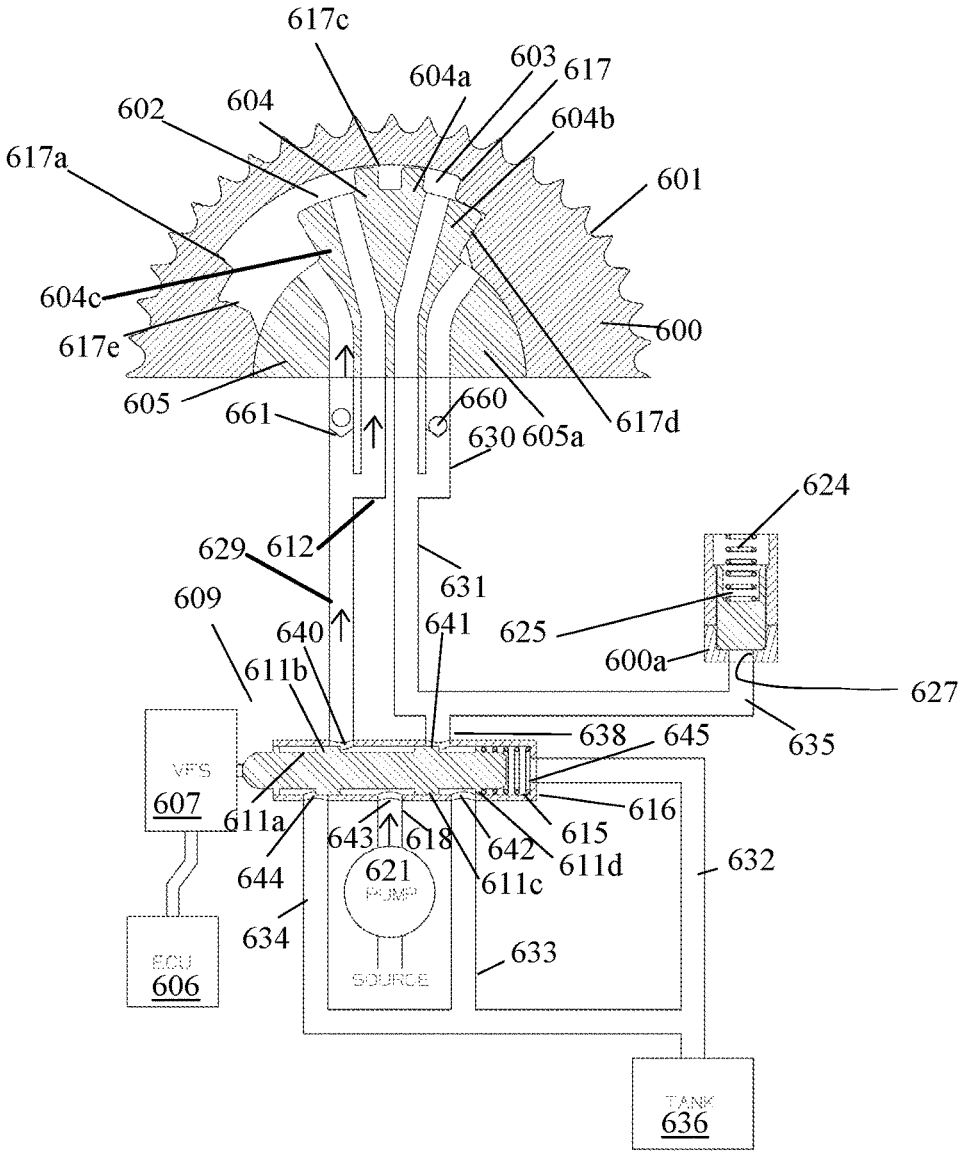
FIG. 27 shows a schematic of the phaser of the sixth embodiment with the phaser in a full advance position with the lock pin leaving the locked position.

FIG. 27 shows the phaser in a full advance position with the lock pin 625 in a locked position. To move towards the full advance position, the duty cycle is adjusted to a range less than 40%, the force of the VFS 607 on the spool 611 is changed and the spool 611 is moved to the left in the figure by the spring 615, until the force of spring 615 balances the force of the VFS 607. The full advance position is a position in which the first protrusion 604*b* of the vane 604 is adjacent and directly contacts the retard wall 617*b* and a retard cushion pocket is no longer present between the first protrusion 604*b* and the retard wall 617*b*. The fluid vacates the retard cushion pocket 672 through leakage at the interface 673 between the first protrusion 604*b* and the housing assembly 600.

In the full advance position, the lock pin 625 can engage the recess 627, locking the movement of the rotor assembly 605 relative to the housing assembly 600. Fluid may be provided by inlet line 618 to the control valve 609 between spool lands 611*b* and 611*c* and to the advance chamber 602 via the advance cushion stop line 629 and the advance line 612. Fluid is blocked from entering the retard chamber 603 from supply by spool land 611*c*. Similarly, supply fluid is additionally blocked from entering exhaust line 635 leading to the lock pin 625 by spool land 611*c*.

In order to leave the locked position at advance, the duty cycle is adjusted to a range of greater than 60%, the force of the VFS 607 on the spool 611 is changed and the spool 611 is moved to the right in FIG. 24.

In the embodiments of the present invention, the one way valve may be replaced with a pressure relief valve.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A variable cam timing phaser comprising:

a housing assembly having an outer circumference which accepts a drive force;

a rotor assembly connected to a camshaft, the rotor assembly coaxially located within the housing assembly, the rotor assembly having a rotor body with at least one vane extending from the rotor body, the at least one vane having a vane body with at least one protrusion extending laterally from the vane body, wherein the housing assembly and the rotor assembly define at least one chamber separated by the at least one vane into an advance chamber and a retard chamber, the at least one chamber defined by an advance wall and a retard wall, the at least one vane within the at least one chamber shifting relative angular position of the housing assembly and the rotor assembly and the at least one vane;

a control valve which directs fluid from a fluid input to and from the advance chamber and the retard chamber;

an advance line in fluid communication with the control valve and the advance chamber;

a retard line in fluid communication with the control valve and the retard chamber;

a cushion stop line in fluid communication with at least one of the advance chamber or the retard chamber;

a lock pin slidably located in the rotor assembly or the housing assembly in fluid communication with the control valve, the lock pin being moveable by the fluid from a locked position in which an end portion engages a recess, locking the relative angular position of the housing assembly and the rotor assembly, to an unlocked position, in which the end portion does not engage the recess;

wherein when the control valve is moved such that the fluid from the fluid input flows to the advance chamber or the retard chamber, and exhausts from a remaining chamber of the retard chamber or the advance chamber, the fluid exhausting from the remaining chamber is captured between the at least one vane, the cushion stop line, and the housing assembly, such that at least one cushion pocket is defined between the at least one protrusion of the at least one vane, the housing assembly, the cushion stop line and one of the retard wall or the advance wall, the at least one cushion pocket cushioning impact of the at least one vane with the one of the retard wall or the advance wall;

wherein when the fluid in the at least one cushion pocket exhausts to the control valve through an interface between the at least one protrusion of the at least one vane and the housing assembly, the lock pin is moved to the locked position; and wherein when the fluid is provided to one of the advance chamber or the retard chamber through the cushion stop line and through a corresponding one of the advance line or the retard line from the control valve, the lock pin is moved to the unlocked position.

2. The phaser of claim 1, wherein the cushion stop line further comprises a one-way valve.

3. The phaser of claim 1, wherein the retard line further comprises a one-way valve.

4. The phaser of claim 1, wherein the lock pin further comprises a body with a first land and a second land, the body being received within a sleeve having a port, wherein when the lock pin is in the unlocked position, the fluid flows between the first land and the second land through the port of the sleeve and when the lock pin is in the locked position, the fluid is blocked from flowing through the port by one of the first land or the second land of the body of the lock pin.

5. The phaser of claim 4, wherein the lock pin is in further fluid communication with the advance chamber or the retard chamber through the cushion stop line.

6. The phaser of claim 1, wherein the lock pin is in fluid communication with the retard chamber through the retard line.

7. The phaser of claim 1, wherein the retard wall further comprises a recess which receives the at least one protrusion.

8. The phaser of claim 1, wherein the advance wall further comprises a recess which receives the at least one protrusion.

9. The phaser of claim 1, wherein the at least one cushion pocket exhausts the fluid through the interface to the control valve through the retard line.

10. The phaser of claim 1, wherein the at least one cushion pocket exhausts the fluid to the cushion stop line and through the control valve to a tank.

11. A variable cam timing phaser comprising:

a housing assembly having an outer circumference which accepts a drive force;

a rotor assembly connected to a camshaft, the rotor assembly coaxially located within the housing assembly, the rotor assembly having a rotor body with at least one vane extending from the rotor body, the at least one vane having a vane body with at least one protrusion extending laterally from the vane body, wherein the housing assembly and the rotor assembly define at least one chamber separated by the at least one vane into an advance chamber and a retard chamber, the at least one chamber defined by an advance wall and a retard wall, the at least one vane within the at least one chamber shifting relative angular position of the housing assembly and the rotor assembly and the at least one vane;

a control valve which directs fluid from a fluid input to and from the advance chamber and the retard chamber;

an advance line in fluid communication with the control valve and the advance chamber;

a retard line in fluid communication with the control valve and the retard chamber;

a cushion stop line in fluid communication with at least one of the advance chamber or the retard chamber;

a lock pin slidably located in the rotor assembly or the housing assembly and in fluid communication with the control valve, the lock pin being moveable by the fluid from a locked position in which an end portion engages a recess, locking the relative angular position of the housing assembly and the rotor assembly, to an unlocked position, in which the end portion does not engage the recess;

wherein when the control valve is moved such that the fluid from the fluid input flows to the advance chamber and exhausts from the retard chamber, the fluid exhausting from the retard chamber is captured between the at least one vane, the retard line, a one-way valve, the retard wall and the at least one chamber of the housing assembly, such that at least one cushion pocket is defined between the at least one protrusion of the at least one vane, the housing assembly, the retard line and the retard wall, the at least one cushion pocket cushioning impact of the at least one vane with the retard wall;

wherein when the fluid in the at least one cushion pocket exhausts to the control valve through an interface between the rotor assembly and the housing assembly, and the control valve blocks the fluid from the fluid input from communicating with the lock pin, the lock pin is moved to the locked position; and wherein when the fluid is provided to the retard chamber through the cushion stop line and through the retard line from the control valve, and the fluid from the fluid input is in communication with the lock pin, the lock pin is moved to the unlocked position.

12. A variable cam timing phaser comprising:

a housing assembly having an outer circumference which accepts a drive force;

a rotor assembly connected to a camshaft, the rotor assembly coaxially located within the housing assembly, the rotor assembly having a rotor body with a first vane and a second vane extending from the rotor body, the first vane having a vane body with at least one protrusion extending laterally from the vane body, wherein the housing assembly and the rotor assembly define a first chamber separated by the first vane into a first advance chamber and a first retard chamber, the first chamber defined by a first advance wall and a first retard wall, and wherein the housing assembly and rotor assembly define a second chamber separated by the second vane into a second advance chamber and a second retard chamber, the second chamber defined by a second advance wall and a second retard wall, the first vane and the second vane shifting relative angular position of the housing assembly and the rotor assembly;

a control valve which directs fluid from a fluid input to and from the first advance chamber, the second advance chamber, the first retard chamber and the second retard chamber;

a first advance line in fluid communication with the first advance chamber;

a second advance line in fluid communication with the control valve and the second advance chamber and the first advance line, a first retard line in fluid communication with the control valve and the first retard chamber;

a second retard line in fluid communication with the control valve and the second retard chamber;

a cushion stop line is in fluid communication with at least one of the first advance chamber or the first retard chamber;

a lock pin slidably located in the rotor assembly or the housing assembly in fluid communication with the control valve and the cushion stop line, the lock pin being moveable by the fluid from a locked position in which an end portion engages a recess, locking the relative angular position of the housing assembly and the rotor assembly, to an unlocked position, in which the end portion does not engage the recess;

wherein when the control valve is moved such that the fluid from the fluid input flows to the first retard chamber, and exhausts from the first advance chamber, the fluid exhausting from the first advance chamber is captured between the first vane, the cushion stop line, and the housing assembly, such that at least one cushion pocket is defined between the at least one protrusion of the first vane, the housing assembly, the cushion stop line and the first retard wall, the at least one cushion pocket cushioning impact of the first vane with the first retard wall or the first advance wall;

wherein when the fluid in the at least one cushion pocket exhausts to the control valve through an interface between the at least one protrusion of the first vane and the housing assembly, the lock pin is moved to the locked position; and wherein when the fluid is provided to the first retard chamber through the cushion stop line and through the first retard line from the control valve, the lock pin is moved to the unlocked position.

13. The phaser of claim 12, wherein the first advance chamber is in fluid communication with the second advance chamber and the control valve through the second advance line.

14. A variable cam timing phaser comprising:

a housing assembly having an outer circumference which accepts a drive force;

a rotor assembly connected to a camshaft, the rotor assembly coaxially located within the housing assembly, the rotor assembly having a rotor body with at least one vane extending the rotor body, the at least one vane having a vane body with a first protrusion extending laterally from a first side of the vane body and a second protrusion extending laterally from a second side of the vane body, wherein the housing assembly and the rotor assembly define at least one chamber separated by the at least one vane into an advance chamber and a retard chamber, the at least one chamber defined by an advance wall and a retard wall, the at least one vane within the at least one chamber shifting relative angular position of the housing assembly and the rotor assembly and the at least one vane;

a control valve which directs fluid from a fluid input to and from the advance chamber and the retard chamber;

an advance line in fluid communication with the control valve and the advance chamber;

a retard line in fluid communication with the control valve and the retard chamber;

an advance cushion stop line having a one-way valve in fluid communication with the advance chamber and the control valve;

a retard cushion stop line having a one-way valve in fluid communication with the retard chamber and the control valve;

a lock pin slidably located in the rotor assembly or the housing assembly in fluid communication with the control valve, the lock pin being moveable by the fluid from a locked position in which an end portion engages a recess, locking the relative angular position of the housing assembly and the rotor assembly, to an unlocked position, in which the end portion does not engage the recess;

wherein when the control valve is moved such that the fluid from the fluid input flows to the advance chamber and exhausts from the retard chamber, the fluid exhausting from the retard chamber is captured between the at least one vane, the retard cushion stop line, and the housing assembly, such that a retard cushion pocket is defined between the first protrusion, the housing assembly, the retard cushion stop line, the one-way valve in the retard cushion stop line and the retard wall, the retard cushion pocket cushioning impact of the at least one vane with the retard wall;

wherein when the fluid in the retard cushion pocket exhausts to the control valve through an interface between the first protrusion of the at least one vane and the housing assembly, the lock pin is moved to the locked position; and wherein when the control valve is moved such that the fluid from the fluid input flows to the retard chamber and exhausts from the advance chamber, the fluid exhausting from the advance chamber is captured between the at least one vane, the advance cushion stop line, and the housing assembly, such that an advance cushion pocket is defined between the second protrusion, the housing assembly, the advance cushion stop line, the one-way valve in the advance cushion stop line and the advance wall, the advance cushion pocket cushioning impact of the at least one vane with the advance wall.

* * * * *